US006378992B2

(12) United States Patent
Kudo et al.

(10) Patent No.: US 6,378,992 B2
(45) **Date of Patent: *Apr. 30, 2002**

(54) LIQUID DISCHARGING HEAD, METHOD FOR MANUFACTURING SUCH LIQUID DISCHARGING HEAD, HEAD CARTRIDGE AND LIQUID DISCHARGING APPARATUS

(75) Inventors: Kiyomitsu Kudo, Yokohama; Hiroshi Sugitani, Machida; Kazuaki Masuda, Kawasaki; Masami Ikeda, Tokyo; Akio Saito, Machida; Tsuyoshi Orikasa, Musashimurayama; Toshio Kashino, Chigasaki; Shuji Koyama, Kawasaki; Hiroyuki Sugiyama, Sagamihara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/890,335

(22) Filed: Jul. 9, 1997

(30) Foreign Application Priority Data

Jul. 9, 1996 (JP) ..... 8-179692

(51) Int. Cl.[7] ..... B41J 2/05
(52) U.S. Cl. ..... 347/63
(58) Field of Search ..... 347/65, 63, 40, 347/49

(56) References Cited

U.S. PATENT DOCUMENTS

| | | | | |
|---|---|---|---|---|
| 4,723,129 A | | 2/1988 | Endo et al. | 347/56 |
| 4,737,801 A | | 4/1988 | Ichihashi et al. | |
| 4,866,461 A | * | 9/1989 | Piatt | 347/63 |
| 4,896,172 A | | 1/1990 | Nozawa et al. | |
| 5,051,759 A | | 9/1991 | Karita et al. | |
| 5,148,194 A | * | 9/1992 | Asai | 347/49 |
| 5,155,502 A | | 10/1992 | Kimura et al. | |
| 5,185,615 A | | 2/1993 | Koitabashi et al. | |
| 5,189,443 A | | 2/1993 | Arashima et al. | |
| 5,237,342 A | | 8/1993 | Saikawa et al. | |
| 5,251,040 A | | 10/1993 | Saito | |
| 5,278,585 A | | 1/1994 | Karz et al. | 347/65 |
| 5,280,299 A | | 1/1994 | Saikawa et al. | |
| 5,481,289 A | | 1/1996 | Arashima et al. | |
| 5,502,479 A | | 3/1996 | Ishinaga et al. | |
| 5,534,898 A | | 7/1996 | Kashino et al. | |
| 5,574,488 A | * | 11/1996 | Tamura | 347/63 |
| 5,621,446 A | | 4/1997 | Tanaka et al. | |
| 5,652,610 A | | 7/1997 | Kawai et al. | |
| 5,821,962 A | * | 10/1998 | Kubo | 347/65 |

FOREIGN PATENT DOCUMENTS

| | | | |
|---|---|---|---|
| DE | 40 39 525 | 6/1992 | B41J/2/16 |
| EP | 0 709 202 A2 | 5/1909 | |
| EP | 0 436 047 | 7/1991 | B41J/2/055 |
| EP | 0 698 493 | 2/1996 | B41J/2/14 |
| EP | 0 737 582 | 10/1996 | B41J/2/16 |
| JP | 1-306251 | 12/1989 | B41J/3/04 |

* cited by examiner

*Primary Examiner*—John Barlow
*Assistant Examiner*—Michael S. Brooke
(74) *Attorney, Agent, or Firm*—Fitzpatrick, Cella, Harper & Scinto

(57) ABSTRACT

The present invention provides a liquid discharging head comprising a substrate having a plurality of heat generating elements for generating a bubble in liquid and a grooved member having a plurality of grooves constituting a plurality of liquid passages and wherein the liquid passages for respective heat generating elements are formed by joining the grooved member to the substrate and further wherein the grooved member has an opening portion into which the substrate is inserted and the opening portion has the plurality of grooves which constitute the liquid passages for the respective heat generating elements when the substrate is inserted into the opening portion.

42 Claims, 22 Drawing Sheets

LIQUID DISCHARGING HEAD, METHOD FOR MANUFACTURING SUCH LIQUID DISCHARGING HEAD, HEAD CARTRIDGE AND LIQUID DISCHARGING APPARATUS

BACKGROUND OF THE INVENTION

1. Field of the Invention

The present invention relates to a liquid discharging head in which desired liquid is discharged by growth of a bubble generated in liquid by applying thermal energy to the liquid, a head cartridge using such a liquid discharging head, and a liquid discharging apparatus having such a liquid discharging head.

The present invention is applicable to printers for effecting the recording on a recording medium such as a paper sheet, a thread sheet, a fiber sheet, a cloth, a leather sheet, a metal sheet, a plastic sheet, glass, wood, ceramic sheet and the like, copying machines, facsimiles having a communication system, word processors having a printer portion, and to industrial recording apparatuses compositely combined to various processing devices.

Incidentally, in this specification and claims, a term "recording" means not only application of a significant image such as a character or a figure onto a recording medium but also application of a meaningless image such as a pattern onto a recording medium.

2. Related Background Art

There has been proposed an ink jet recording method, i.e., a bubble jet recording method in which change in state of ink including abrupt change in volume of ink (generation of a bubble) is caused by applying thermal energy to the ink and the ink is discharged from a discharge opening by an acting force due to such change in the ink state, thereby forming an image on a recording medium by adhering the ink to the recording medium. As disclosed in U.S. Pat. No. 4,723,129, a liquid discharging head used in such a bubble jet recording method includes discharge openings for discharging ink, ink passages communicated with the discharge openings, and heat generating elements (electro/thermal converters) disposed in the ink passages and acting as energy generating means for generating energy for discharging the ink.

FIG. 33 schematically shows a construction of a conventional liquid discharging head. Now, an arrangement and an assembling method of the conventional liquid discharging head will be briefly explained with reference to FIG. 33.

A liquid discharging head 200 comprises a heater board (element substrate) 101 on which a plurality of heaters (heat generating resistance elements) for applying thermal energy to ink are disposed, a grooved top plate 150 having a plurality of grooves constituting nozzles and a common liquid chamber communicated with the grooves, and a holding spring 178. The liquid discharging head 200 includes a chip tank 180 acting as a liquid supply member for the head 200 when connected to an ink tank 190, and a base plate 170 as a substrate having a circuit board 171. The liquid discharging head is assembled with the ink tank 190 to form a head cartridge.

In order to assemble these elements, after the heater board 101 is adhered to the base plate 170, the top plate 150 is temporarily adhered to the heater board 101 with the heaters aligned with the nozzle grooves. Thereafter, in a condition that the top plate is fixed under pressure with the heater board 101 by a press spring, the top plate and the heater board are heat-welded to the base plate 170, together with the chip tank 180. Lastly, the chip tank 180 is connected to the ink tank 190 by fitting the base plate 170 onto positioning pins 194, 195 of the ink tank 190 and heat-welding the base plate to the ink tank.

According to the ink jet recording method using such a liquid discharging head, a high quality image can be recorded at a high speed with low noise.

Further, in the head performing such a recording method, since the discharge openings for discharging the ink can be arranged with high density, not only an image having high resolving power but also a color image can easily be recorded with a compact structure. Thus, the bubble jet recording method has recently been used in various office equipments such as printers, copying machines, facsimiles and the like, as well as industrial systems such as print devices.

However, when the conventional liquid discharging head as shown in FIG. 33 is assembled, since the number of parts is great and the assembling processes are complicated, the liquid discharging head cannot be manufactured cheaply. Accordingly, the inventors aims to provide a liquid discharging head having a structure which can be assembled and manufactured easily and cheaply.

First of all, a liquid discharging liquid passage structure and a liquid discharging principle applied to a liquid discharging head of the present invention will be explained with reference to FIGS. 1A, 1B, 1C, 1D, 2, 3, 4, 5, 6, 7, 8A and 8B.

FIGS. 1A to 1D are schematic sectional views of a liquid discharging head taken along a liquid passage and showing liquid discharging steps, and FIG. 2 is a partial sectional perspective view of the liquid discharging head.

The liquid discharging head according to the illustrated embodiment includes an element substrate 1 on which a heat generating element 2 (rectangular heat generating resistance member having a dimension of 40 $\mu$m×105 $\mu$m, in FIG. 2) for acting thermal energy on liquid (as discharge energy generating element for generating energy for discharging the liquid) is arranged, and a liquid passage 10 is formed above the element substrate 1 in correspondence to the heat generating element 2. The liquid passage 10 communicates with a discharge opening 18 and also communicates with a common liquid chamber 13 for supplying the liquid to a plurality of liquid passages 10, and receives the liquid corresponding to the discharged liquid from the common liquid chamber 13.

Within the liquid passage 10, above the element substrate 1, a movable member 31 formed from material having elasticity such as metal is disposed in a cantilever fashion in a confronting relation to the heat generating element 2. One end of the movable member 31 is secured to bases (support member) 34 formed by patterning photosensitive resin on walls of the liquid passage 10 and on the element substrate 1. As a result, the movable member 31 is held in such a manner that the movable member can be displaced around a fulcrum (support portion) 33.

The movable member 31 has the fulcrum (support portion; fixed end) 33 positioned at an upstream side of large flow of liquid flowing from the common liquid chamber 13 through the movable member 31 to the discharge opening 18 and a free end (free end portion) 32 disposed at a downstream side of the fulcrum 33, and is disposed in a confronting relation to the heat generating element 2 to cover the heat generating element 2 and is spaced apart from the heat generating element 5 upwardly by about 15 $\mu$m. A bubble generating area is defined between the heat generating element and the movable member. Incidentally, kinds, configurations and dispositions of the heat generating element 2 and the movable member 31 are not limited to the above-mentioned ones, but, the heat generating element and the movable member may be configured and disposed to control growth of a bubble and transmission of bubble pressure, which will be described later. In the present invention, since the free end 32 has an adequate width, growing power of the bubble can easily be directed toward the discharge opening 18. Incidentally, for the explanation of a liquid flow which will be described later, the liquid passage 10 is explained to have a first liquid passage 14 (at one side of the movable member 31) directly communicated with the discharge opening 18 and a second liquid passage 16 (at the other side of the movable member) including a bubble generating area 11 and a liquid supply passage 12.

Heat is applied to the liquid in the bubble generating area 11 between the movable member 31 and the heat generating element 2 by heating the heat generating element 2, and a bubble is formed in the liquid by a film-boiling phenomenon as disclosed in U.S. Pat. 4,723,129. Pressure caused by the formation of the bubble, and the bubble act on the movable member preferentially to displace the movable member 31 around the fulcrum 33 to be greatly opened toward the discharge opening, as shown in FIGS. 1B, 1C and 2. By the displacement or a displaced condition of the movable member 31, a transmitting direction of the pressure caused by the formation of the bubble and a growing direction of the bubble itself are oriented toward the discharge opening. In this case, since the free end 32 has the adequate width, the growing power of the bubble can easily be directed toward the discharge opening 18.

Now, one of fundamental discharging principles of the present invention will be described. The most important principle of the present invention is to displace or shift the movable member (disposed in a confronting relation to the bubble) from a first position (normal condition) to a second position (displaced condition) by the pressure of the bubble or the bubble itself, so that the pressure caused by the formation of the bubble and the bubble itself are oriented to a downstream side in which the discharge opening 18 is disposed, by the displaced movable member 31.

This principle will be fully explained while comparing FIG. 3 (schematically showing a structure of a conventional liquid passage not having the movable member) and FIG. 4 (showing the present invention). Incidentally, here, the pressure transmitting direction toward the discharge opening is shown by the arrows VA and a pressure transmitting direction toward the upstream side is shown by the arrows VB.

In the conventional head as shown in FIG. 3, there is no means for regulating a transmitting direction of the pressure caused by formation of a bubble 40. Thus, the pressure of the bubble 40 is transmitted toward various directions as shown by the arrows V1–V8 perpendicular to a surface of the bubble. Among them, the pressure transmitting directions V1–V4 have components directing toward the direction VA which is most effective to the liquid discharging, and the pressure transmitting directions V1–V4 are positioned on a left half of the bubble near the discharge opening and contribute to the liquid discharging efficiency, liquid discharging force and liquid discharging speed. Further, since the pressure transmitting direction V1 is directed to the discharging direction VA, it is most effective; whereas, the pressure transmitting direction V4 has smallest component directing toward the discharging direction VA.

To the contrary, in the present invention shown in FIG. 4, the pressure transmitting directions V1–V4 which are directed to various directions in FIG. 3 are oriented toward the downstream side (i.e., toward the discharge opening) by the movable member 31 (i.e., various pressure transmitting directions is converted to the downstream direction VA), with the result that the pressure of the bubble 40 contributes to the liquid discharging directly and effectively. Similar to the pressure transmitting directions V1–V4, the growing direction of the bubble is directed toward the downstream side, with the result that the bubble is grown more greatly at the downstream side than at the upstream side. By controlling the growing direction of the bubble itself and the pressure transmitting direction of the bubble by means of the movable member, the discharging efficiency, discharging force and discharging speed can be improved.

Next, a discharging operation of the liquid discharging head according to the illustrated embodiment will be fully described with reference to FIGS. 1A to 1D.

FIG. 1A shows a condition before energy such as electrical energy is applied to the heat generating element 2, i.e., before heat is generated from the heat generating element 2. It is important that the movable member 31 is disposed in a confronting relation to at least a downstream portion of the bubble which will be formed by the heat from the heat generating element 2. That is to say, the movable member 31 extends up to at least a position downstream of a center 3 of an area of the heat generating element in the liquid passage (i.e., downstream of a line passing through the center 3 of the area of the heat generating element and extending perpendicular to the length of the liquid passage) so that the downstream portion of the bubble acts on the movable member.

FIG. 1B shows a condition that the heat generating element 2 is heated by applying the electrical energy to the heat generating element 2 and the bubble is formed by the film-boiling caused by heating a portion of the liquid contained in the bubble generating area 11 by utilizing the heat from the heat generating element.

In this case, the movable member 31 is displaced or shifted by the pressure caused by the formation of the bubble 40 from the first position to the second position to direct the pressure transmitting direction of the bubble 40 toward the discharge opening. Here, it is important that, as mentioned above, the free end 32 of the movable member 31 is disposed at the downstream side and the fulcrum 33 is disposed at the upstream side (near the common liquid chamber) and at least a portion of the movable member is faced to the downstream portion of the heat generating element (i.e., downstream portion of the bubble).

FIG. 1C shows a condition that the bubble 40 is further growing and the movable member 31 is further displaced by the pressure caused by the growth of the bubble 40. The generated bubble is grown more greatly at the downstream side than at the upstream side, and the bubble is greatly grown to exceed the first position (dotted line) of the movable member. As mentioned above, since the movable member 31 is gradually displaced as the bubble 40 is growing, the pressure transmitting direction of the bubble 40 is regulated to a direction toward which the pressure transmitting direction is apt to be oriented or the volume of the bubble is apt to be shifted (i.e., to the free end), with the result that the growing direction of the bubble is uniformly oriented toward the discharge opening 18, thereby increasing the discharging efficiency. When the bubble and the bubble pressure are oriented toward the discharge opening, the movable member does almost not regulate such orientation, with the result that the transmitting direction of the pressure and the growing direction of the bubble can be controlled efficiently in accordance with the magnitude of the pressure transmitted. Further, since the free end 32 has the adequate width, the growing power of the bubble can easily be directed toward the discharge opening 18.

FIG. 1D shows a condition that, after the film-boiling, the bubble 40 is contracted and disappeared due to the reduction of pressure in the bubble.

The movable member 31 which was displaced to the second position is returned to the initial (first position) shown in FIG. 1A by negative pressure due to contraction of the bubble and the elastic returning force of the movable member itself. Further, when the bubble is disappeared, in order to compensate an amount corresponding to the contracted volume of the bubble at the bubble generating area 11 and to compensate an amount corresponding to the discharged liquid, the liquid flows from the upstream side B (i.e., from the common liquid chamber) as flows $VD_{D1}$, $V_{D2}$ and from the discharge opening side as a flow $V_C$.

While the operation of the movable member and the liquid discharging operation due to the generation of the bubble were explained, now, re-fill of the liquid in the liquid discharging head of the present invention will be fully explained.

After the condition shown in FIG. 1C, when the bubble 40 having the maximum volume is being disappeared, an amount of the liquid corresponding to the reduced volume of the bubble flows into the bubble generating area from the discharge opening 18 side of the first liquid passage 14 and from the common liquid chamber 13 side of the second liquid passage 16. In the conventional liquid passage structure not having movable members 31, an amount of the liquid flowing into the bubble disappearing position from the discharge opening side and an amount of the liquid flowing into the bubble disappearing position from the common liquid chamber depend upon flow resistance between the discharge opening and the bubble generating area and flow resistance between the common liquid chamber and the bubble generating area (i.e., depend upon resistance of the liquid passages and inertia of liquid).

Thus, when the flow resistance between the discharge opening and the bubble generating area is smaller, a relatively large amount of liquid flows into the bubble disappearing position from the discharge opening side to increase a retard amount of meniscus. Particularly, as the liquid discharging efficiency is increased by reducing the flow resistance between the discharge opening and the bubble generating area, the retard amount of the meniscus M during the disappearance of the bubble is increased accordingly, thereby increasing the re-fill time, and, thus, preventing the high speed recording.

To the contrary, in the illustrated embodiment, because of the provision of the movable member 31, when it is assumed that an upper volume portion of a volume W of the bubble above the first position of the movable member is W1 and a lower volume portion of the bubble below the first position is W2, at the time when the movable member is returned to its initial position during the disappearance of the bubble, the retard movement of the meniscus is stopped. Thereafter, the liquid corresponding to the residual volume portion W2 is mainly sullied from the flow VD2 in the second liquid passage 16. Accordingly, although the retard amount of the meniscus corresponded to about a half of the bubble volume W in the conventional techniques, in the illustrated embodiment of the present invention, the retard amount of the meniscus can be suppressed to about a half of the volume portion W1, smaller than that in the conventional techniques.

Further, since the supply of the liquid corresponding to the volume portion W2 can be forcibly effected by utilizing the negative pressure (generated due to the disappearance of the bubble) mainly from the upstream second liquid passage (flow $V_{D2}$) along a surface of the movable member 31 facing to the heat generating element, the re-fill time can be shortened.

When the re-fill is effected by utilizing the negative pressure during the disappearance of the bubble in the conventional head, the fluctuation of the meniscus becomes great to cause the deterioration of the image quality. To the contrary, in the high speed re-fill according to the illustrated embodiment, since the flowing of the liquid in the first liquid passage 14 near the discharge opening into the bubble generating area 11 near the discharge opening is suppressed by the movable member, the fluctuation of the meniscus M can be minimized.

In this way, according to the present invention, since the high speed re-fill is achieved by the forcible re-fill of the liquid into the bubble generating area from the liquid supply passage 12 of the second liquid passage 16 and suppression of the retard or fluctuation of the meniscus, the stable liquid discharging and high speed repeat discharging can be realized, and, when applied to the recording field, the high quality image and high speed recording can be realized.

In the arrangement according to the present invention, there is also provided the following effective function. That is to say, the transmission of the pressure caused by the formation of the bubble to the upstream side (back-wave) can be suppressed. The pressure of the bubble portion (near the common liquid chamber 13 (upstream side)) of the bubble generated on the heat generating element 2 tends to push the liquid back to the upstream side (to cause the back-wave). The back-wave creates upstream pressure, upstream movement of the liquid and an inertia force due to the liquid movement, which resist the re-fill of the liquid into the liquid passage, thereby affecting a bad influence upon the high speed recording. In the present invention, since such upstream pressure, upstream liquid movement and inertia force can be suppressed by the movable member 31, the re-fill ability can be further improved.

Next, a further characteristic construction and advantage therefor in the illustrated embodiment will be described.

The second liquid passage 16 according to the illustrated embodiment has the liquid supply passage 12 having an inner wall flatly contiguous to (i.e., flush with) the heat generating element 2 at the upstream side of the heat generating element 2. In such a case, the supply of the liquid to the bubble generating area 11 and the surface of the heat generating element 2 is effected along the surface of the movable member 31 facing to the bubble generating area 11 (as flow $VD_{D2}$). Thus, stagnation of liquid on the heat generating element 2 is prevented, with the result that gas included in the liquid and the residual bubble can easily be removed and excessive accumulation of heat in the liquid can be avoided. Accordingly, more stable formation of bubble can be repeated at a high speed. Incidentally, in the illustrated embodiment, while an example that the liquid supply passage 12 has a substantially flat inner wall was explained, the inner wall of the liquid supply passage is not limited to such an example, but may have a gentle slope or other shape smoothly contiguous to the surface of the heat generating element to prevent the stagnation of liquid on the heat generating element and disturbance of the supplied liquid.

Further, in some cases, the supply of the liquid to the bubble generating area is effected through the side (slit 35)

of the movable member 31. However, in order to direct the bubble pressure toward the discharge opening more effectively, as shown in FIG. 1, a large movable member may be used to cover the entire bubble generating area (entire surface of the heat generating element). In this case, when the flow resistance between the bubble generating area 11 and an area near the discharge opening in the first liquid passage 14 is great, by returning the movable member 31 to its first position, the flow of the liquid from $V_{D1}$ toward the bubble generating area 11 is prevented. However, in the illustrated embodiment, since there is the flow $V_{D1}$ for supplying the liquid to the bubble generating area, the liquid supplying ability is enhanced, so that, even when the structure in which the bubble generating area 11 is covered by the movable member 31 to improve the liquid discharging efficiency is used, the liquid supplying ability is not so worsened.

By the way, regarding the positions of the free end 32 and the fulcrum 33 of the movable member 31, for example, as shown in FIG. 5, the free end is disposed at a downstream side of the fulcrum. With this arrangement, when the bubble is being formed, the pressure transmitting direction and the growing direction of the bubble can be oriented or directed toward the discharge opening 18 effectively. Further, this positional relation not only contributes to the improvement of the discharging efficiency or ability but also reduces flow resistance of the liquid flowing through the liquid passage 10 during the supply of liquid, thereby achieving the high speed re-fill. The reason is that, as shown in FIG. 5, when the meniscus M retarded due to the liquid discharging is restored toward the discharge opening 18 by a capillary phenomenon and/or when the liquid is supplied to compensate the disappeared bubble, the free end and the fulcrum 33 are arranged not to resist against the liquid flows S1, S2, S3 flowing in the liquid passage 10 (including the first and second liquid passages 14, 16).

Further, in FIG. 1, as mentioned above, the free end 32 of the movable member 31 extends up to the position downstream of the center 3 of the area of the heat generating element 2 (i.e., downstream of the line passing through the center of the area of the heat generating element and extending perpendicular to the length of the liquid passage 10). Thus, the pressure and the downstream portion of the bubble 40 which are generated at the downstream side of the center 3 of the area of the heat generating element and greatly contribute to the liquid discharging are supported by the movable member 31, with the result that the pressure and the bubble can be directed toward the discharge opening, thereby improving the discharging efficiency and discharging force.

In addition, by utilizing the upstream portion of the bubble, various advantages can be achieved. Further, in the illustrated embodiment, the momentary mechanical displacement of the free end of the movable member 31 also contributes to the improvement of the liquid discharging.

FIG. 6 is a schematic sectional view of a liquid discharging head according to another embodiment of the present invention, taken along a liquid passage, and FIG. 7 is a partial fragmental perspective view of the liquid discharging head of FIG. 6. In this embodiment, although the main liquid discharging principle is the same as the first embodiment, the first liquid passage 14 and the second liquid passage 16 are isolated by a separation wall 30 having movable member 31 as will be described later so that liquid (bubble liquid) in which a bubble is formed by applying heat to the liquid is separated from liquid (discharge liquid) which is mainly to be discharged.

In FIGS. 6 and 7, a liquid discharging head according to this embodiment includes an element substrate 1 on which a heat generating element 2 for applying thermal energy for forming a bubble in the liquid is arranged, a second liquid passage 16 for the bubble liquid disposed on the element substrate 1, and a first liquid passage 14 for the discharge liquid directly communicated with the discharge opening 18 and disposed above the second liquid passage.

Regarding a structure of the first liquid passage 14 from an upstream side to a downstream side, as shown, a height of the first liquid passage is gradually increased with respect to the movable member 31 toward the discharge opening. In other words, flow resistance is selected so that the free end 32 of the movable member 31 can easily be displaced with respect to the fulcrum 33 in the first liquid passage 14.

An upstream side portion of the first liquid passage 14 is communicated with a first common liquid chamber 15 for supplying the discharge liquid to the plurality of first liquid passages 14, and an upstream side portion of the second liquid passage 16 is communicated with a second common liquid chamber 17 for supplying the bubble liquid to the plurality of second liquid passages 16.

However, when the same liquid is used both as the bubble liquid and as the discharge liquid, a single common liquid chamber may be used.

A separation wall 30 formed from elastic material such as metal is disposed between the first liquid passage and the second liquid passage to isolate the first liquid passage from the second liquid passage. Incidentally, when the mixing between the bubble liquid and the discharge liquid is desired to prevent as much as possible, the liquid in the first liquid passage 14 is isolated from the liquid in the second liquid passage 16 by the separation wall as much as possible; whereas, when the bubble liquid and the discharge liquid maybe mixed to some extent, the separation wall may not have the perfect separation function.

A portion of the separation wall positioned in an upper projection space regarding the heat generating element (referred to as "discharge pressure generating area" hereinafter; area A and area B of the bubble generating area 11 in FIG. 6) constitutes a movable member 31 having a free end 32 disposed at the discharge opening (i.e., toward a downstream side in the liquid flowing direction) and a fulcrum 33 disposed at the common liquid chamber (15, 17) side. Since the movable member 31 is disposed in a confronting relation to the bubble generating area 11 (B), the movable member 31 is moved (as shown by the arrow) by the bubble in the bubble liquid to be opened toward the discharge opening in the first liquid passage. In this case, since the free end of the movable member is more displaceable than the fulcrum, the free end is displaced in accordance with growth of the bubble, thereby directing the bubble toward the discharge opening efficiently. The separation wall 30 is disposed above the element substrate 1 on which heat generating resistance elements as the heat generating elements 2 and wiring electrodes (not shown) for applying electrical signals to the corresponding heat generating resistance elements are arranged, with the interposition of a space defining the second liquid passages.

The positional relation between the fulcrum 33 and the free end 32 of the movable member 31 and the heat generating element are the same as the former embodiments.

Further, while the structural relation between the liquid supply passage 12 and the heat generating element 2 was explained in the previous embodiment, also in this embodiment, a structural relation between the second liquid passage 16 and the heat generating element 2 is the same as the above-mentioned structural relation.

Next, an operation of the liquid discharging head according to this embodiment will be explained with reference to FIGS. 8A and 8B.

Regarding the operation of the head, as the discharge liquid supplied to the first liquid passage 14 and the bubble liquid supplied to the second liquid passage 16, the same water base ink is used.

When the bubble liquid in the bubble generating area in the second liquid passage is subjected to the heat from the heat generating element 2, as is in the former embodiments, a bubble 40 is formed in the bubble liquid by film-boiling phenomenon as disclosed in U.S. Pat. No. 4,723,129.

In this embodiment, since the bubble pressure cannot escape through three sides (downstream side and both lateral sides) except through the upstream side of the bubble generating area, the pressure caused by the formation of the bubble is concentrated and transmitted toward the movable member 31, so that, as the bubble is growing, the movable member 31 is displaced from a condition shown in FIG. 8A to a condition shown in FIG. 8B toward the first liquid passage. This movement of the movable member causes the second liquid passage 16 to greatly communicate with the first liquid passage 14, with the result that the pressure of the bubble is mainly transmitted to a direction toward the discharge opening in the first liquid passage (i.e., direction A). The liquid is discharged from the discharge opening 18 by such transmission of the pressure and the mechanical displacement of the movable member.

Then, as the bubble is being contracted, the movable member 31 is returned to condition shown in FIG. 8A, and, in the first liquid passage 14, the discharge liquid corresponding to an amount of the discharged liquid is supplied from the upstream side. Also in this embodiment, since the supply of the discharge liquid is effected toward a direction for closing the movable member as is in the former embodiments, the re-fill of the discharge liquid is not prevented by the movable member.

While function and advantage regarding the transmission of the bubble pressure due to the displacement of the movable member, the growing direction of the bubble and the prevention of the backwave in this embodiment are the same as the first embodiment, the two-liquid passage structure of this embodiment further provides the following advantages.

That is to say, according to the arrangement of this embodiment, since the discharge liquid and the bubble liquid are isolated from each other, the discharge liquid can be discharged by the pressure of the bubble formed in the bubble liquid. Thus, even when high-viscous liquid (such as polyethylene glycol) in which a bubble was not adequately formed and provided only poor discharging force is used, by supplying such high-viscous liquid in the first liquid passage and by supplying liquid (mixed liquid having about 1 to 2 cp; and, ethanol: water = 4:6) in which a bubble can easily be formed or liquid having low boiling point in the second liquid passage, the good discharging can be achieved.

Further, by selecting liquid in which deposit due to heat is not accumulated on the surface of the heat generating element as the bubble liquid, the formation of the bubble can be stabilized and good discharging can be achieved.

In addition, since the head according to this embodiment provides the advantages same as the former embodiments, the liquid such as high-viscous liquid can be discharged with high discharging efficiency and high discharging force.

Further, even when liquid having poor resistance to heat is used, by supplying such liquid in the first liquid passage as discharge liquid and by supplying liquid having good resistance to heat and facilitating the formation of the bubble in the second liquid passage, the liquid can be discharged with high discharging efficiency and high discharging force and without thermal damage of the liquid.

While the liquid passage structure of the liquid discharging head performing the characteristic discharging principle of the present invention was explained with regard to one-liquid passage type and two-liquid passage type, now, an assembled structure of the liquid discharging head and a head cartridge comprised of such a liquid discharging head and an ink tank, which can be applied to the above-mentioned embodiments, can be manufactured easily and cheaply and are effective to high density arrangement of nozzles and in which the number of parts can be reduced and the head can easily be elongated will be explained.

Further, it was found that such a structure which can be manufactured easily and cheaply can also be applied to a head having a new liquid discharging principle utilizing a bubble which could not obtained in the conventional techniques.

SUMMARY OF THE INVENTION

A first object of the present invention is to provide a liquid discharging head in which the number of parts is small and which can be manufactured easily and cheaply.

A second object of the present invention is to provide a liquid discharging head in which acccumulation of heat in liquid on heat generating element can be reduced greatly while improving liquid discharging efficiency and a discharging force and good liquid discharging can be achieved by reducing a residual bubble on the heat generating element.

A third object of the present invention is to provide a liquid discharging head in which an inertia force of a back-wave can be suppressed or prevented from acting toward a direction opposite to a liquid supplying direction and re-fill frequency is increased by reducing a retard amount of meniscus by a valve function of a movable member, thereby improving a recording speed.

To achieve the above objects, the present invention provides a liquid discharging head comprising a substrate having a plurality of heat generating elements for generating a bubble in liquid and a grooved member having a plurality of grooves constituting a plurality of liquid passages and wherein the liquid passages for respective heat generating elements are formed by joining the grooved member to the substrate and further wherein the grooved member has an opening portion into which the substrate is inserted and the opening portion has the plurality of grooves which constitute the liquid passages for the respective heat generating elements when the substrate is inserted into the opening portion.

Further, the grooved member has discharge openings communicated with the plurality of grooves of the opening portion. A method for manufacturing such a liquid discharging head is characterized by inserting the substrate into the opening portion while widening the opening portion when the substrate is inserted into the opening portion, and securely holding the substrate within the opening portion by a restoring force of the grooved member. In this case, in order to widen the opening portion of the grooved member, heat is applied to the grooved member and tension is applied to the grooved member in directions that the opening portion is widened.

The liquid discharging head having the above-mentioned construction may further include movable members each of which is disposed in a confronting relation to the corresponding heat generating element and has a free end near the corresponding discharge opening and serves to direct pressure of a bubble generated by the corresponding heat generating element toward the corresponding discharge opening by displacing the free end by the bubble pressure, or, may further include such movable members and liquid supply passages for supplying the liquid onto the heat generating elements from an upstream side along surfaces of the movable members near the heat generating elements.

Alternatively, the liquid discharging head having the above-mentioned construction may be designed so that the liquid passages are divided into first liquid passages communicated with the discharge openings and second liquid passages each including a bubble generating area in which a bubble is generated in the liquid by applying heat to the liquid, and there are provided movable members each having a free end near the corresponding discharge opening and each serving to direct pressure of a bubble generated in the corresponding bubble generating area toward the corresponding discharge opening of the first liquid passage by displacing the free end toward the first liquid passage by the bubble pressure.

Alternatively, the liquid discharging head may comprise an element substrate having a plurality of heat generating elements for generating a bubble in liquid, and a grooved member having an opening portion into which the substrate can be inserted and a plurality of grooves for constituting a plurality of liquid passages when the substrate is inserted in the opening portion and wherein the liquid passages are divided into first liquid passages communicated with the discharge openings and second liquid passages within which the respective heat generating elements are disposed and may further comprise a separation wall having movable members each capable of being displaced by pressure of a generated bubble to direct the pressure toward the corresponding discharge opening thereby to discharge the liquid.

The present invention further provides a head cartridge comprising such a liquid discharging head and a liquid container for holding liquid to be supplied to the liquid discharging head.

The present invention also provides a liquid discharging apparatus comprising such a liquid discharging head, and a drive signal supplying means for supplying a drive signal for causing the liquid discharging head to discharge the liquid or a recording medium conveying means for conveying a recording medium for receiving the liquid discharged from the liquid discharging head.

With the arrangement as mentioned above, by providing the opening portion (into which the substrate having the plurality of heat generating elements for generating a bubble can be inserted) in the grooved member having the plurality of grooves for constituting the plurality of liquid passages so that the liquid passages for the respective heat generating elements are formed when the substrate is inserted within the opening portion, since the liquid discharging head can be completed merely by inserting the substrate into the opening portion of the grooved member, the number of parts can be reduced and the head can be assembled easily and cheaply, in comparison with conventional liquid discharging heads. Particularly, since the grooved member has a simple structure only having the plurality of grooves, the grooved member can easily be manufactured and is effective to nozzle arrangement with high density. Further, since any chamber in the grooved member corrected by press-fitting the element substrate into the opening portion of the grooved member, an elongated substrate can be used. In addition, by press-fitting the substrate from a direction perpendicular to the array of grooves, walls defining the grooves are not fallen. Further, since the element substrate is closely contacted with the grooved member by the press-fit, any holding spring is not required unlike to the conventional techniques.

According to the liquid discharging head according to the present invention based on the new discharging principle, since a combined effect between the bubble generated and the movable member displaced by the bubble pressure contributes to discharge the liquid near the discharge opening efficiently, the liquid discharging efficiency can be improved in comparison with the conventional bubble jet discharging methods and heads. For example, in a preferred embodiment of the present invention, the liquid discharging efficiency can be improved by twice or more in comparison with the conventional techniques.

According to the characteristic arrangement of the present invention, even if the head is placed under a low temperature condition and/or a low humidity condition for a long time, the poor discharging can be prevented. If the poor discharging occurs, merely by effecting a recovery treatment such as preliminary discharge and/or suction recovery, the normal condition can easily be restored.

Specifically, even under a long term placement condition wherein many conventional bubble jet heads having 64 discharge openings occur the poor discharging, in the head of the present invention, only about a half or less of the discharge openings cause the poor discharging. Further, when such a head is restored by the preliminary discharge, it was found that, in the conventional head, about 1000 preliminary discharges must be effected for each discharge opening; whereas, in the head of the present invention, the head can be restored merely by about 100 preliminary discharges. This means that the recovery time and the liquid loss during the recovery operation can be reduced and the running cost can be reduced greatly.

Further, according to the arrangement of the present invention in which the re-filling feature is improved, the response in the continuous liquid discharging, stable growth of the bubble and stability of liquid droplets can be improved, thereby permitting high speed recording due to high speed liquid discharging and high quality image recording.

The other advantages of the present invention will be apparent from the detailed explanation of respective embodiments of the present invention.

Incidentally, in the specification and claims, the terms "upstream" and "downstream" are referred to regarding the liquid flowing direction from the liquid supply source through the bubble generating area (or movable member) to the discharge opening, or the constructural direction.

Further, the term "downstream side" regarding the bubble itself mainly means a discharge opening side portion of the bubble directly relating the liquid discharging. More particularly, it means a bubble portion generated at a downstream of a center of the bubble in the liquid flowing direction or the constructural direction or at downstream of a center of the area of the heat generating element.

Further, in the specification and claims, the term "substantially closed" or "substantially sealed" means a condition that, when the bubble is growing, before the movable member is shifted, the bubble cannot escape through a gap (slit) at a downstream side of the movable member.

In addition, the term "separation wall" means a wall (which may include the movable member) disposed to separate the bubble generating area from a area directly communicated with the discharge opening in a broader sense, and means a wall for distinguishing the liquid passage including the bubble generating area from the liquid passage directly communicated with the discharge opening and for preventing the mixing of the liquids in both liquid passages in a narrower sense.

DETAILED DESCRIPTION OF THE PREFERRED EMBODIMENTS

The present invention will now be explained in connection with embodiments thereof with reference to the accompanying drawings. Incidentally, the present invention is not limited to such embodiments, but may include any embodiments without departing from the scope of the invention.

The embodiments disclose a new liquid discharging head which can be manufactured easily and cheaply and can easily be elongated and in which the number of parts can be reduced and nozzles can be arranged with high density. Further, the liquid discharging head has a unique liquid discharging mechanism for efficiently utilizing a bubble generated on a corresponding heat generating element which will be described later.

Figure 9:
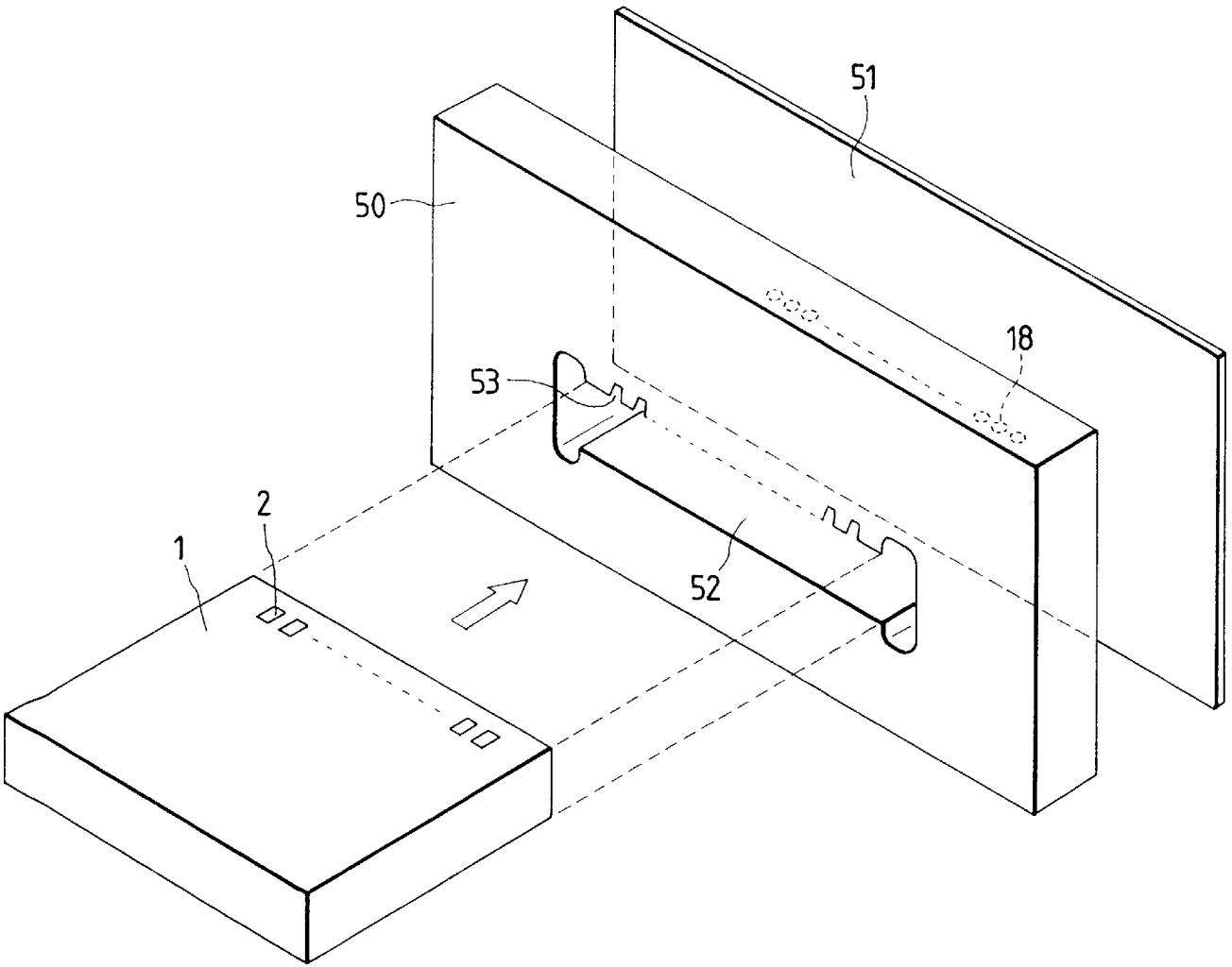
FIG. 9 is a perspective view showing a fundamental assembled condition of the liquid discharging head according to the present invention.

First of all, a fundamental assembled structure of the liquid discharging head according to the present invention will be explained. FIG. 9 is a perspective view showing the assembled structure of the liquid discharging head of the present invention.

As shown in FIG. 9, the liquid discharging head comprises an element substrate 1, a grooved member 50, and an orifice film 51. An array of heat generating elements for applying heat the discharge liquid is provided on the element substrate 1. The grooved member 50 has an opening portion 52 into which the element substrate 1 is inserted, and a plurality of grooves 53 corresponding to the heat generating elements 2 provided on the element substrate 1 are formed in an inner surface of the opening portion 52. By joining the element substrate 1 to the grooved member 50, discharge liquid passages (not shown) through which the discharge liquid to be discharged flows are formed.

The orifice film 51 is adhered to the grooved member 50 to close the opening portion 52 of the grooved member 50. The orifice film 51 is formed from resin film such as polyethylene or metal film. A plurality of discharge opening 18 are formed in the orifice film 51 in association with the respective grooves 53 of the grooved member 50. The discharge openings 18 may be formed in the orifice film by laser perforation before or after the orifice film is adhered to the grooved member.

By adopting such a head structure, since the grooved member has a simple construction merely having the plurality of grooves, the grooved member can easily be manufactured and is effective to the high density arrangement of nozzles. Further, by press-fitting the element substrate into the opening portion of the grooved member, since camber generated in the grooved member during the manufacture thereof can be corrected, the substrate can easily be elongated. In addition, since the element substrate is inserted into the opening portion in a direction perpendicular to the array of grooves, walls defining the grooves are not deformed. Unlike to the conventional techniques, since the element substrate is closely fitted into the grooved member by press-fitting the substrate into the member, any holding spring is not required.

Figure 10:
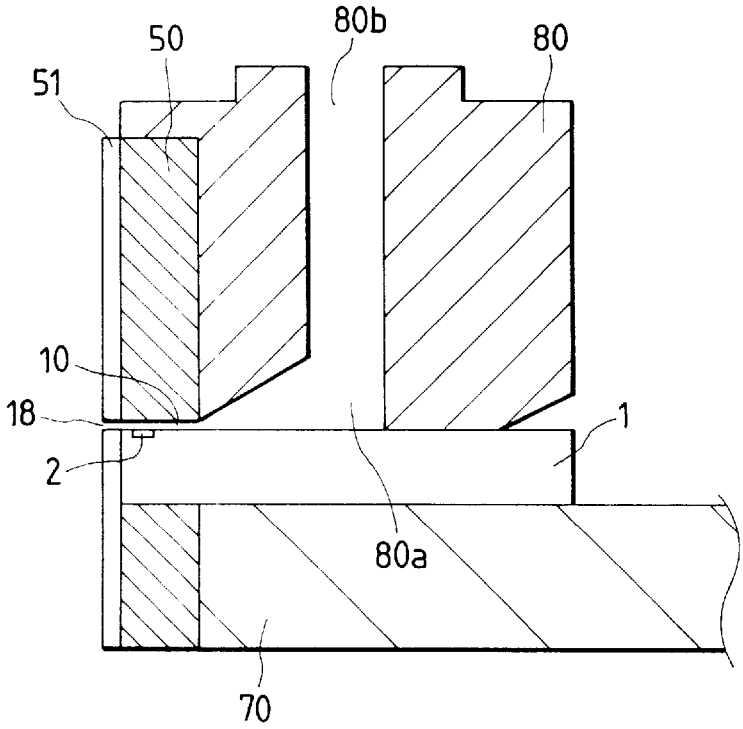
FIG. 10 is a sectional view of an assembly of the liquid discharging head shown in FIG. 9, a base plate and a liquid supplying member.

Further, an ink supply member and a base plate may be assembled with the fundamental structure of the liquid discharging head. Such a case is shown in FIG. 10 (sectional view). As shown in FIG. 10, a part of the grooved member 50 abuts against an end surface of the base plate 70 and the element substrate 1 is supported by the base plate 70 made of aluminium. Further, the liquid (ink) supply member 80 is rested on the element substrate 1 secured to the base plate and on the grooved member 50. By securing the liquid supply member 80 to the substrate and the grooved member, a common liquid chamber 80*a* communicated with the liquid passages 10 in which the heat generating elements 2 are disposed and a liquid supply passage 80*b* for supplying the liquid to the common liquid chamber 80*a* are provided in the liquid discharging head.

Now, an assembling method for assembling the liquid discharging head having the above-mentioned fundamental structure will be explained with reference to FIG. 11. When the element substrate 1 is inserted into the opening portion 52 of the grooved member 50, an upper surface (on which the heat generating elements are disposed) of the element substrate 1 is contacted with a surface (in which the grooves 53 constituting the liquid passages are formed) of the grooved member 50. In order not to damage the element substrate 1 and groove walls 54, the element substrate 1 is inserted into the opening portion in a condition that heat is applied to the grooved member 50 to permit easy deformation and tension for expanding the opening portion 52 is applied to the surface in which the grooves 53 are formed and to an opposed surface. Since the grooved member 50 and the element substrate 1 have a press-fit relation, a positioning process for aligning the heat generating elements 2 on the element substrate 1 with the grooves 53 of the grooved member 50 is not required, thereby simplifying the assembling method of the head. After the element substrate 1 was inserted into the opening portion 52 of the grooved member 50 in this way, when the applied heat and tension are released, since the grooved member 50 is formed from elastically-deformable material, the element substrate 1 is closely contacted with the grooved member 50 by an elastic restoring force of the grooved member.

Thereafter, the liquid supply member 80 is rested on the element substrate 1 secured to the base plate 70 and on the grooved member and a pair of legs 80*c* of the liquid supply member 80 are inserted into a pair of holes 70*a* formed in the base plate 70 in such a manner that free ends of the legs 80*c* protrude from a lower surface of the base plate 70. In this case, the liquid supply member 80 is urged against the base plate 70 so that the legs 80*c* are protruded from the holes 70*a* of the base plate 70. In this condition, by heat-welding the free end portions of the legs 80*c* to the lower surface of the base plate 70, the liquid supply member 80 is secured to the base plate 70.

Figure 12:
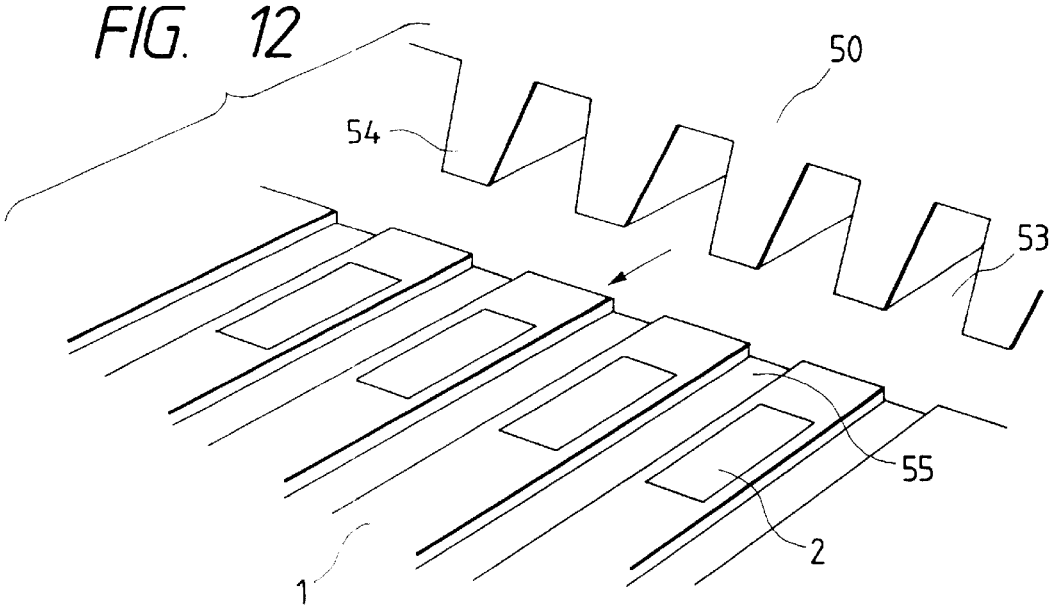
FIG. 12 is a partial enlarged perspective view showing a condition that an element substrate is press fit into a grooved member.

Incidentally, the element substrate 1 may include recessed grooves 55 with which the groove walls 54 defining the grooves of the grooved member 50 are engaged when the element substrate 1 is inserted into the opening portion of the grooved member 50. FIG. 12 is an enlarged perspective view showing a condition that the element substrate 1 is press-fitted into the grooved member 50. The recessed grooves 55 shown in FIG. 12 are formed by patterning thin films and ground films forming the heat generating elements when the heat generating elements 2 are formed on the element substrate 1. Since the heat generating elements 2 and wirings are not disposed in the recessed grooves, even when the films are removed from the recessed grooves by patterning, the element substrate 1 is not subjected to a bad influence. In the illustrated embodiment, while a depth of each recessed groove 55 is selected to about 2.2 $\mu$m, recessed grooves having about 3 $\mu$m may be formed by patterning. With this arrangement, even if the close contact between the grooved member 50 and the element substrate 1 is slightly worsened, there is no liquid leakage between the liquid passage defined by the groove walls 54. On the other hand, positioning accuracy between the heat generating elements 2 on the element substrate 1 and the grooves 53 of the grooved member 50 can be improved.

Figure 1A:
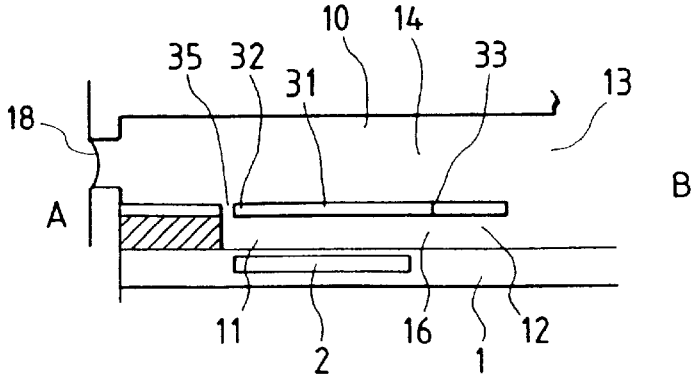
FIG. 1A PRIOR ART
FIGS. 1A, 1B, 1C and 1D are schematic sectional views for explaining a liquid passage structure and a discharging principle of a liquid discharging head according to the present invention.
Figure 1B:
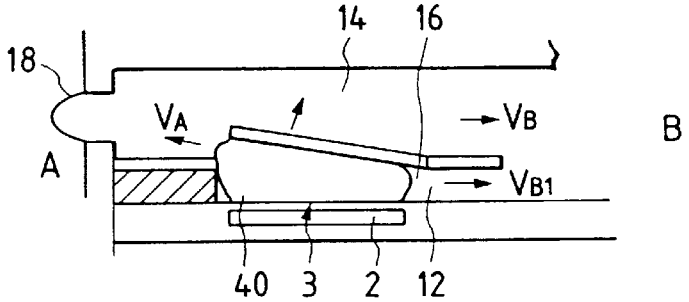
FIG. 1B PRIOR ART
Figure 1C:
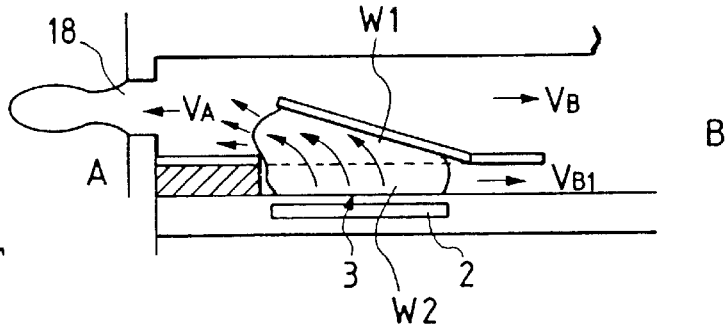
FIG. 1C PRIOR ART
Figure 1D:
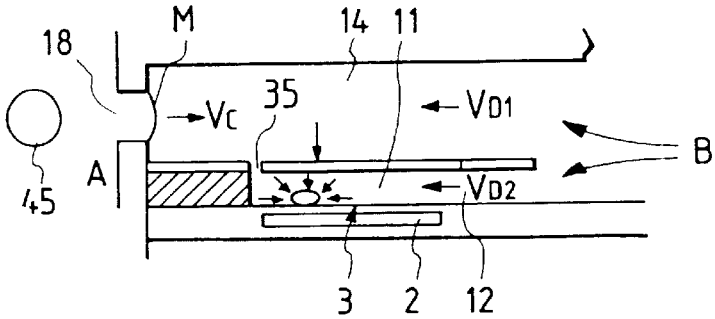
FIG. 1D PRIOR ART
Figure 2:
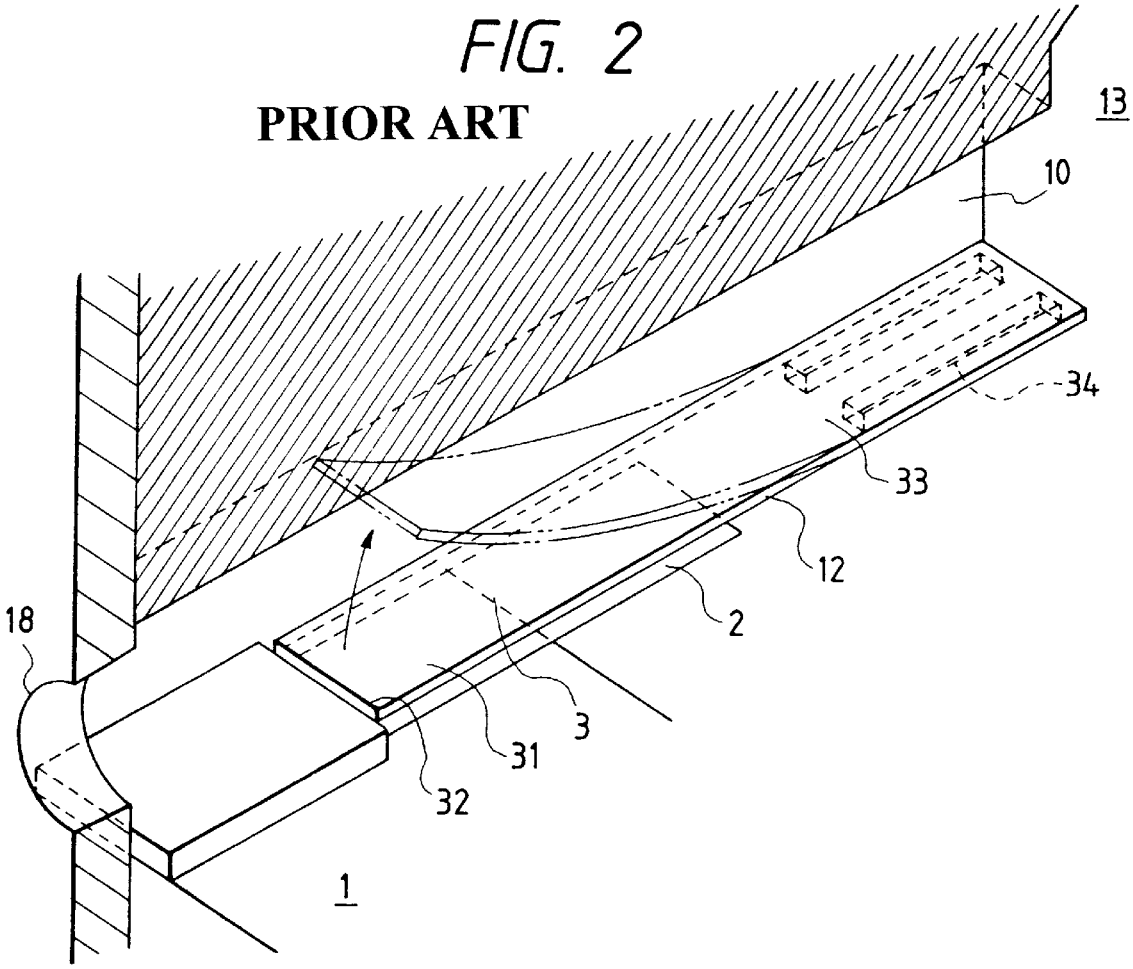
FIG. 2 PRIOR ART
FIG. 2 is a partial sectional perspective view of a liquid discharging head according to an embodiment of the present invention.
Figure 3:
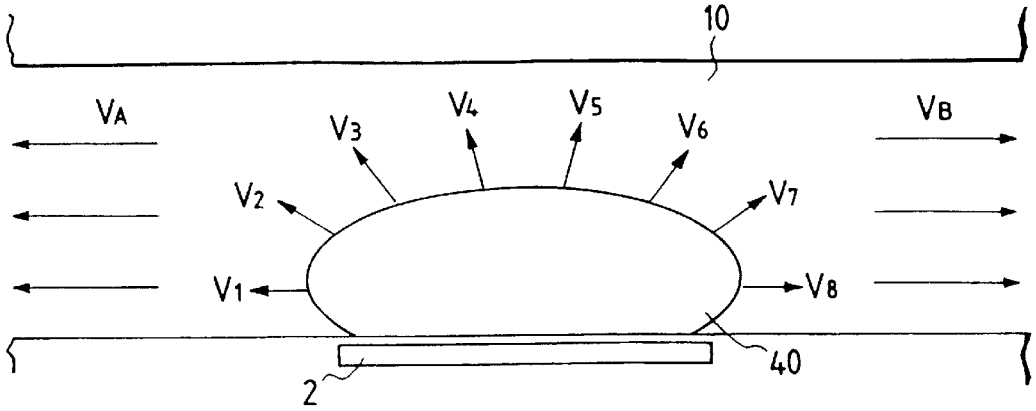
FIG. 3 PRIOR ART
FIG. 3 is a schematic view showing pressure transmission from a bubble in a conventional head.
Figure 4:
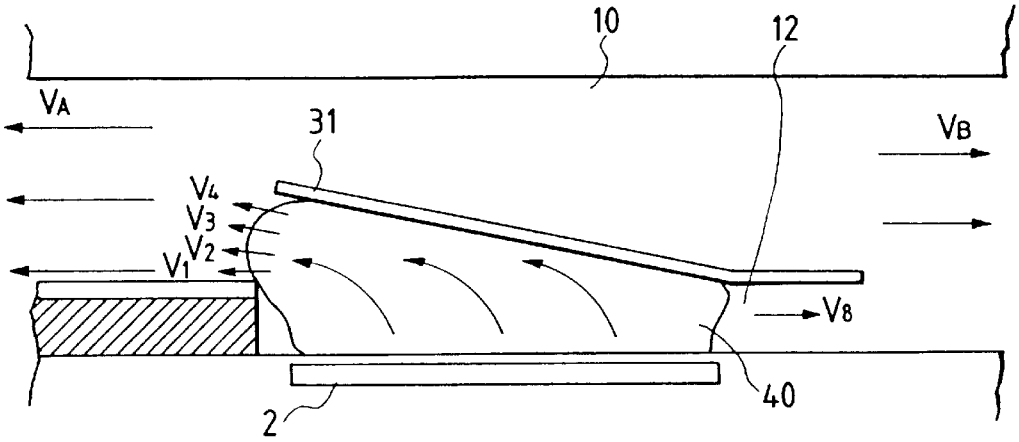
FIG. 4 PRIOR ART
FIG. 4 is a schematic view showing pressure transmission from a bubble in a head according to the present invention.
Figure 5:
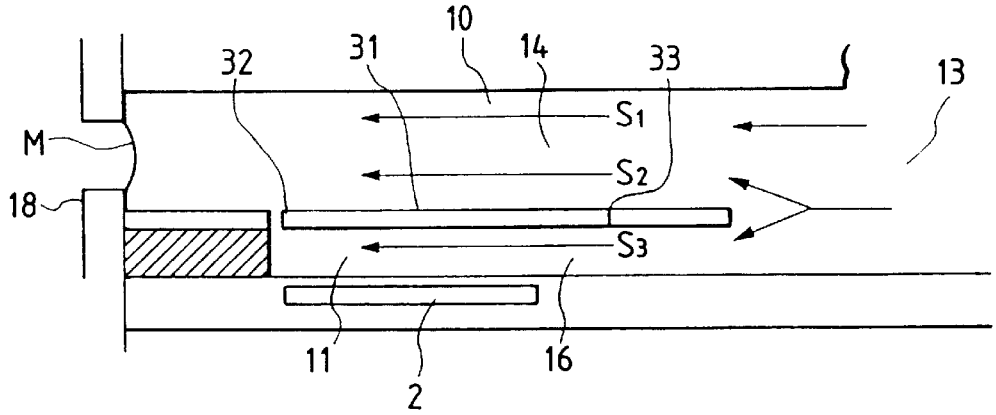
FIG. 5 PRIOR ART
FIG. 5 is a schematic view for explaining flows of liquid in the present invention.
Figure 6:
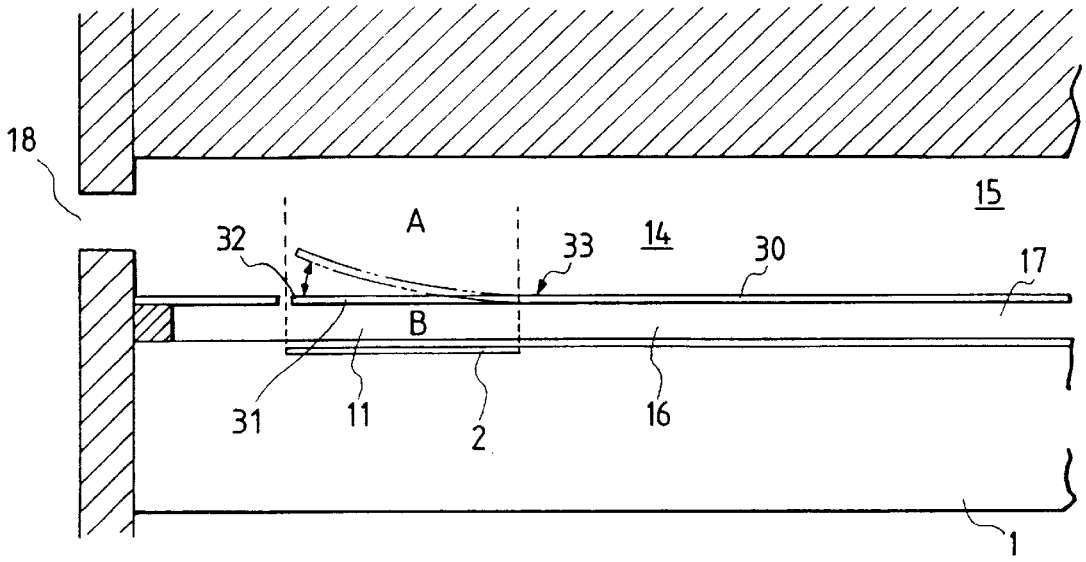
FIG. 6 PRIOR ART
FIG. 6 is a schematic sectional view showing a liquid discharging head of two-liquid passage type according to another embodiment of the present invention.
Figure 7:
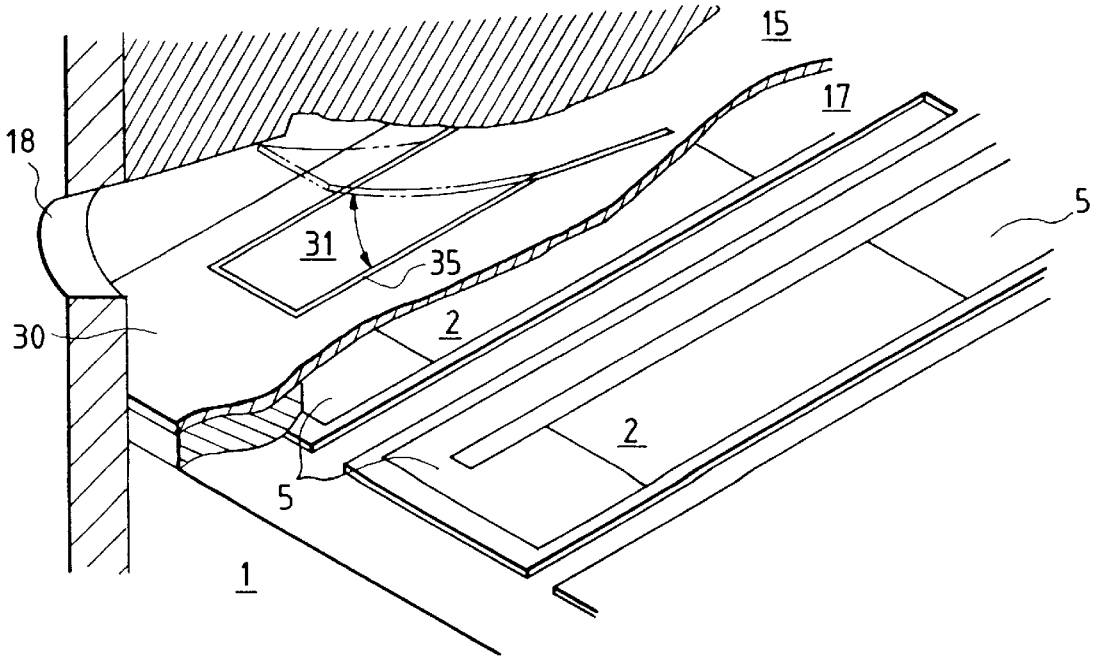
FIG. 7 PRIOR ART
FIG. 7 is a partial sectional perspective view of a liquid discharging head according to a further embodiment of the present invention.
Figure 8A:
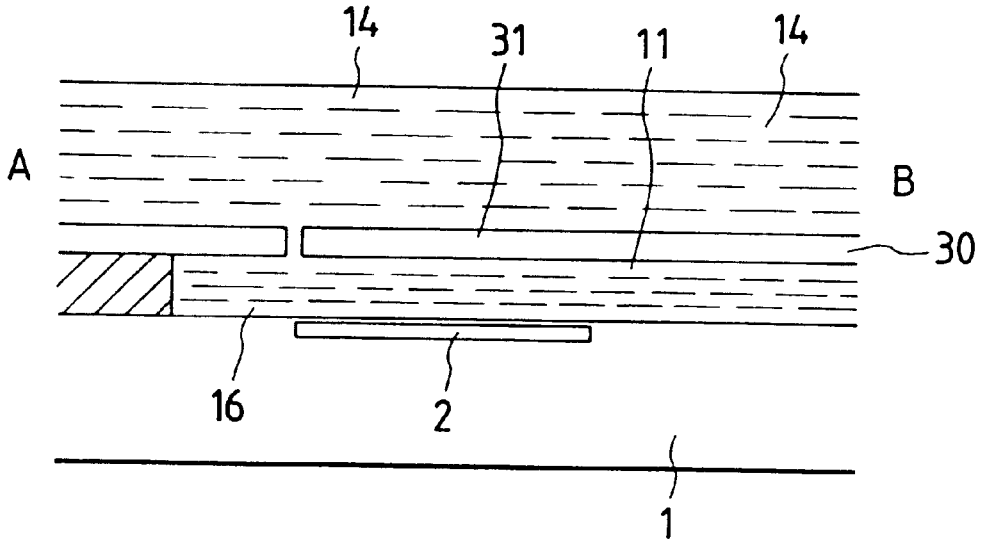
FIG. 8A PRIOR ART
FIGS. 8A and 8B are views for explaining an operation of a movable member of the liquid discharging head shown in FIG. 6.
Figure 8B:
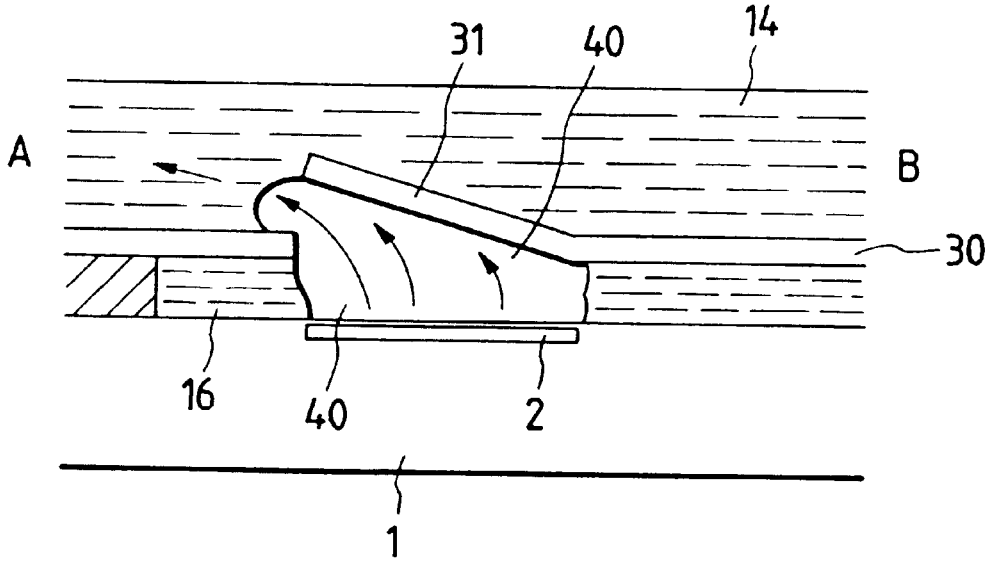
FIG. 8B PRIOR ART
Figure 15:
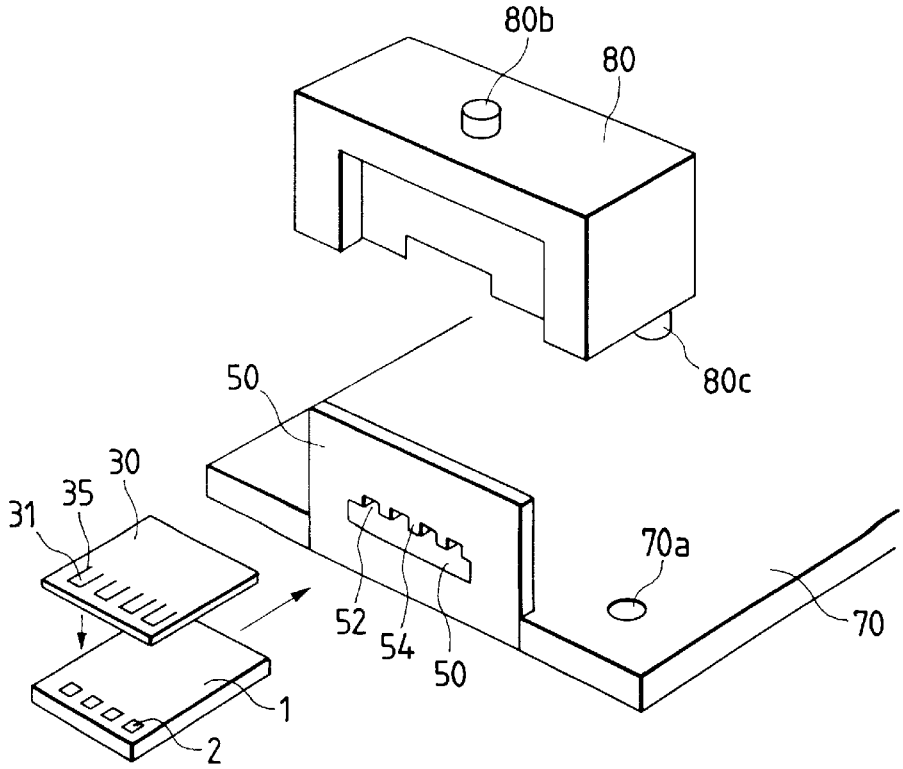
FIG. 15 is a perspective view for explaining another example of a method for assembling a liquid discharging head according to the present invention having movable members disposed in a confronting relation to heat generating elements in liquid passages.

Now, an assembling method for assembling the liquid discharging head having the above-mentioned characteristic liquid passage structure having the movable members will be explained. Here, the head having two-liquid passage structure will be described. FIG. 15 is a perspective view for explaining an example of a method for assembling a liquid discharging head having movable members disposed in the liquid passages in a confronting relation to heat generating elements. In FIG. 15, a separation wall 30 formed from metal material such as nickel, gold and the like or elastic material such as resin film (for example, polyethylene film) which can be finely worked is disposed above an element substrate 1 on which a plurality of heat generating elements 2 are disposed. The separation wall 30 includes narrow slits 35 for defining movable members 31. As shown in FIG. 6, a space between the separation wall 30 and the element substrate 1 is divided into second liquid passages for the bubble liquid corresponding to the respective heat generating elements 2 by second liquid passage walls (not shown). The element substrate 1 having the second liquid passage walls defining the second liquid passages corresponding to the respective heat generating elements 2 and the separation wall 30 positioned so that the movable members 31 are aligned with the respective heat generating elements 2 of the element substrate 1 are inserted into the opening portion 52 of the grooved member 50. Incidentally, in this case, the groove walls 54 of the grooved member 50 are closely contacted with the separation wall 30 so that first liquid passages 14 (refer to FIG. 6) are defined between the grooves 53 of the grooved member 50 and the separation wall 30. As mentioned above, the element substrate and the separation wall are inserted in the condition that the opening portion 52 of the grooved member 50 is expanded by heat and tension.

Figure 13:
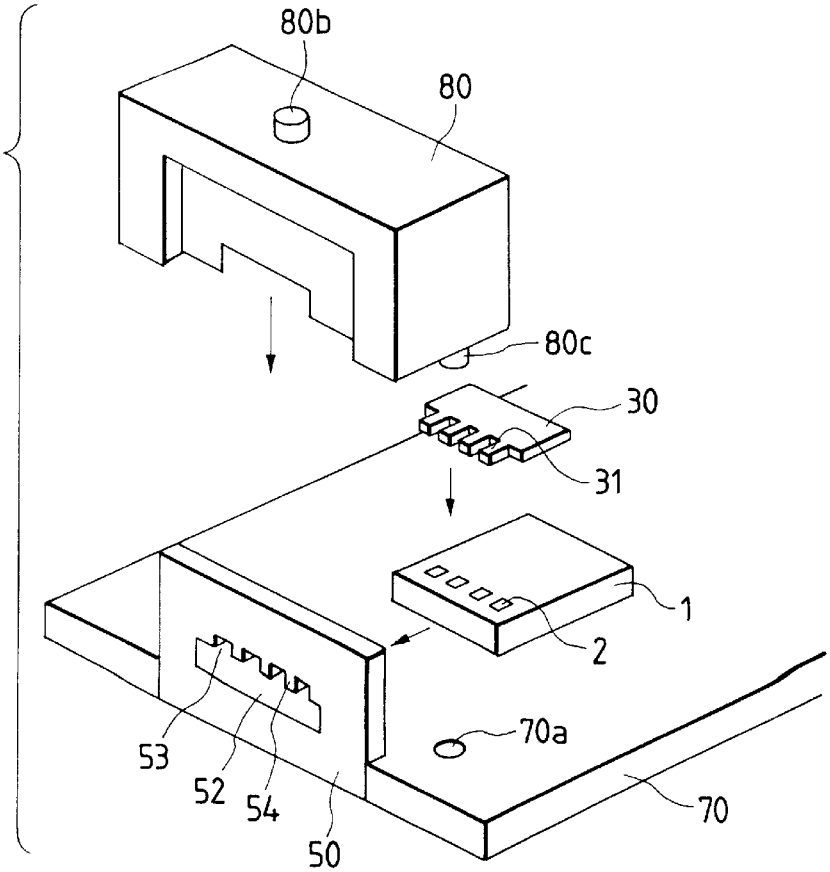
FIG. 13 is a perspective view for explaining an example of a method for assembling a liquid discharging head according to the present invention having movable members disposed in a confronting relation to heat generating elements in liquid passages.
Figure 14:
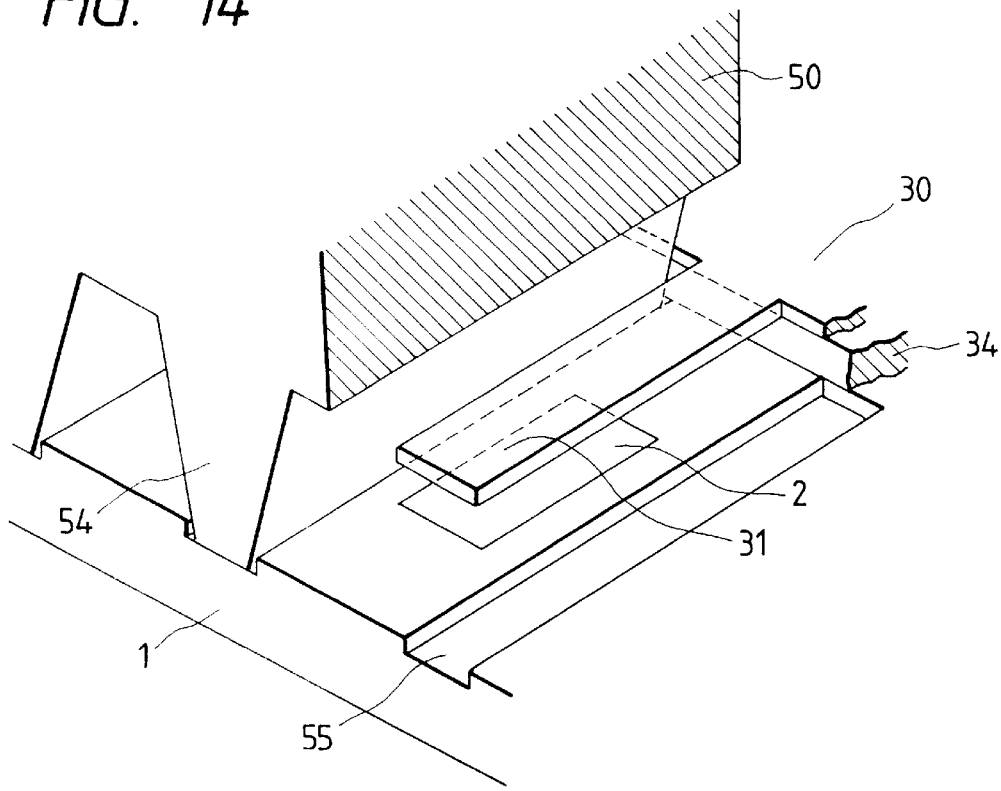
FIG. 14 is a perspective view showing an assembled condition of the parts shown in FIG. 13.

Incidentally, in case of the assembling of the head having one-liquid passage structure, for example, as shown in FIG. 13, the element substrate 1 is inserted into the opening portion 52 of the grooved member 50 in a condition that a separation wall 30 having comb-shaped movable members 31 is supported so that the movable members are aligned with the respective heat generating elements 2 on the element substrate 1. In this way, the heat generating elements 2 and the movable members 31 are arranged within the grooves 53 of the grooved member 50. An assembled condition of such a head is shown in FIG. 14. As shown in FIG. 14, when the element substrate 1 is inserted into the opening portion of the grooved member 50, the groove walls 54 defining the grooves of the grooved member 50 are engaged by the recessed grooves 55 formed in the element substrate 1, thereby aligning the heat generating elements 2 of the element substrate 1 with the grooves 53 of the grooved member 50 with high accuracy.

Figure 11:
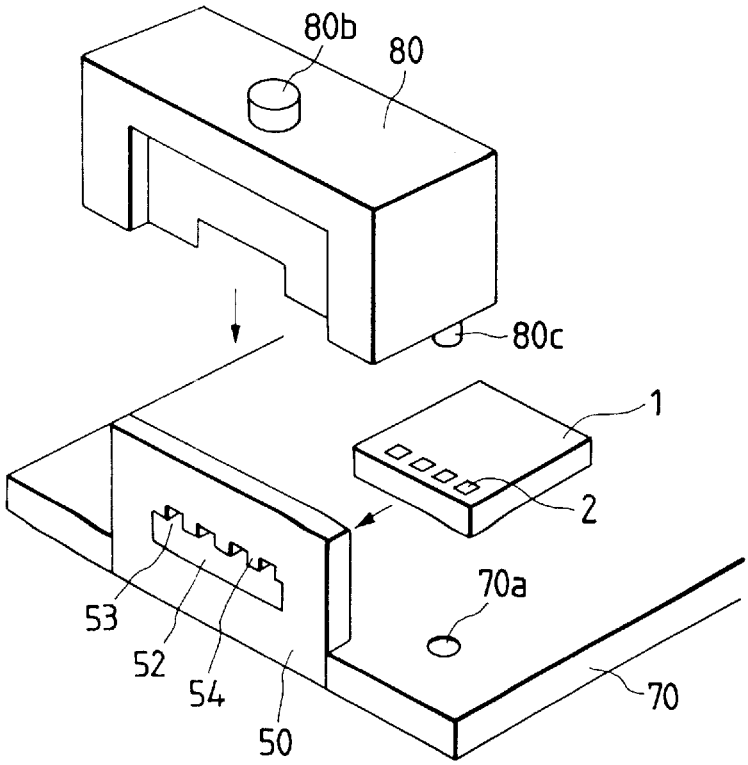
FIG. 11 is a perspective view for explaining a fundamental method for assembling the liquid discharging head of the present invention.

Further, a direction along which the element substrate 1 is inserted into the opening portion 52 of the grooved member 50 is not limited to a direction that the element substrate is inserted from its tip end as shown in FIGS. 11 and 13, but may be a direction that the element substrate is inserted from its trail end as shown in FIG. 15. Particularly, in the head structure shown in FIG. 15, if tip ends (free ends 32) of the movable members 31 of the separation wall 30 secured to the element substrate 1 are floating due to camber and the like, when the element is inserted from its tip end, the floating free ends may be caught by the groove walls 54 of the movable member 50 to damage or bend the movable members 31. To avoid this, it is desirable that the element substrate 1 is inserted from its trail end.

Since other head structures can be considered, some examples of a preferred structure will be explained.

Figure 16A:
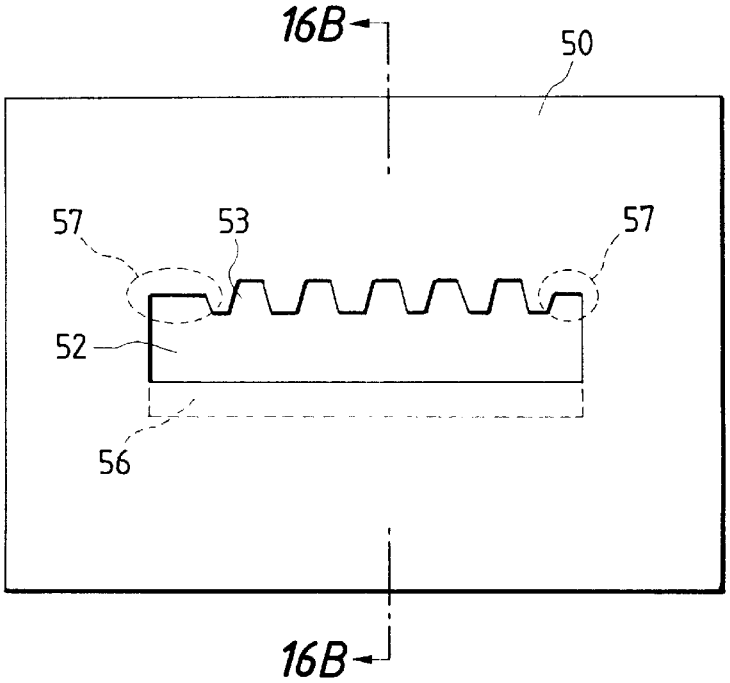
FIG. 16A is a front view showing an alteration of a grooved member constituting the liquid discharging head of the present invention.
Figure 16B:
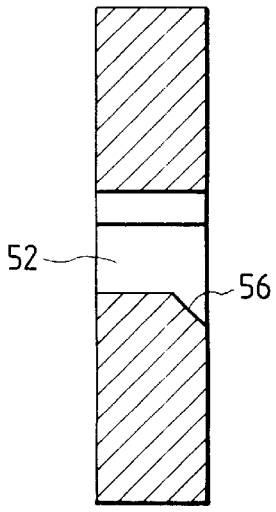
FIG. 16B is a sectional view taken along the line 16B—16B in FIG. 16A.

FIGS. 16A and 16B show an alteration of the grooved member, where FIG. 16A is a front view of the grooved member according to the alteration and FIG. 16B is a sectional view taken along the line 16B—16B in FIG. 16A. As shown in FIGS. 16A and 16B, the grooved member 50 has an opening portion 52 provided at its opening edge with a tapered portion 56. By providing such a tapered portion 56, the press-fit of the element substrate 1 can be facilitated, thereby preventing the damage of the groove walls during the press-fit. Further, by providing flanks 57 outside of outermost groove walls, merely due to dimensional accuracy of heights of the groove walls 54 of the opening portion 52 the close contact between the element substrate 1 and the grooved member 50 can be improved.

Figure 17A:
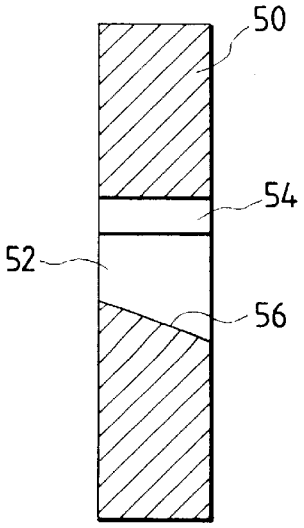
FIGS. 17A and 17B are sectional views showing examples of taper of an opening portion of grooved member shown in FIG. 15.
Figure 17B:
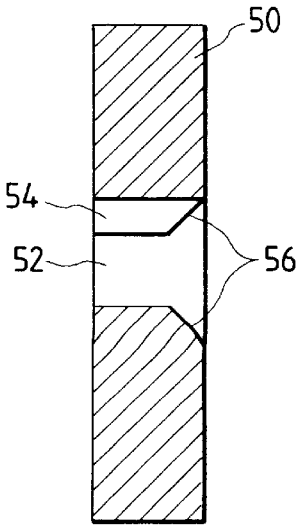

FIGS. 17A and 17B are sectional views showing other examples of a tapered portion of the opening portion of the grooved member. So long as a tapered portion permits the close contact between the element substrate 1 and the groove walls 54 of the grooved member 50, a tapered portion 56 may be formed to extend from one of opening edges to the other as shown in FIG. 17A or a tapered portion may also be formed on each groove walls 54, as well as the tapered portion 56 formed along the opening edge, as shown in FIG. 17B.

Figure 18:
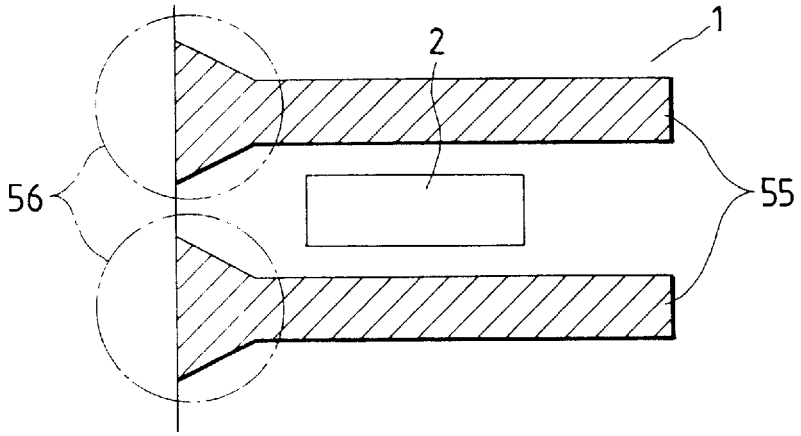
FIG. 18 is a plan view showing a preferred condition when the separation wall and the element substrate shown in FIG. 13 are inserted.
Figure 19:
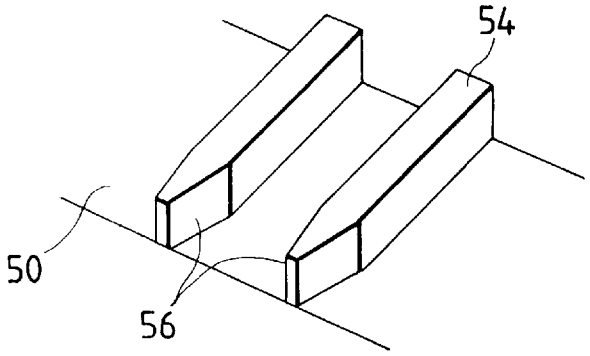
FIG. 19 is a perspective view showing a preferred condition when the separation wall and the element substrate shown in FIG. 13 are inserted.
Figure 20:
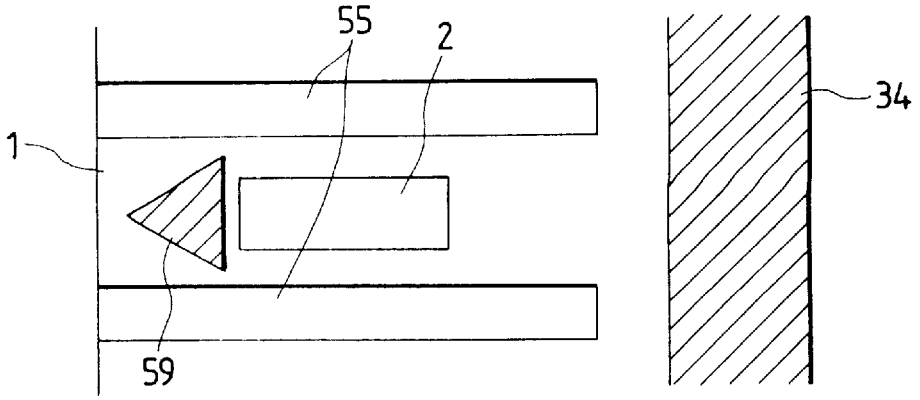
FIG. 20 is a plan view showing a preferred condition when the separation wall and the element substrate shown in FIG. 13 are inserted.

FIGS. 18 to 20 show more preferred conditions when the element substrate 1 and the separation wall 30 having the comb-shaped movable members 31 shown in FIG. 13 are inserted into the opening portion of the grooved member 50. FIG. 18 shows the surface of the element substrate 1 on which the heat generating element 2 is formed. In this case, by providing tapered portions 56 in inserting ends of the recessed grooves 55 of the element substrate 1, the insertion of the substrate element can be facilitated. FIG. 19 shows the surface of the opening portion of the grooved member 50 on which the groove walls 54 are formed. In this case, by providing tapered portions 56 on the protruded groove walls 54 of the grooved member 50, the insertion of the substrate element can be facilitated. Incidentally, in order to further facilitate the insertion of the substrate element, it is preferable that tapered portions are formed both on the groove walls 54 and in the recessed grooves 55. FIG. 20 shows the surface of the element substrate 1 on which the heat generating element 2 is formed. In this case, triangular protruded members 59 to be engaged by corresponding grooves 53 between the groove walls 54 of the grooved member are formed at the inserting end of the element substrate 1, so that the position of the element substrate 1 can easily be determined when the element substrate is inserted into the grooved member. The protruded members 59 may be formed by dry film simultaneously with the support members 34 for supporting the separation wall 30. Incidentally, in the arrangements shown in FIGS. 18 to 20, in order to provide the liquid passages when the element substrate is inserted into the grooved member, the heights of the groove walls 54 of the grooved member 50 are greater than depth of the recessed grooves 55 of the element substrate 1 and heights of the protruded members 59.

Figure 21:
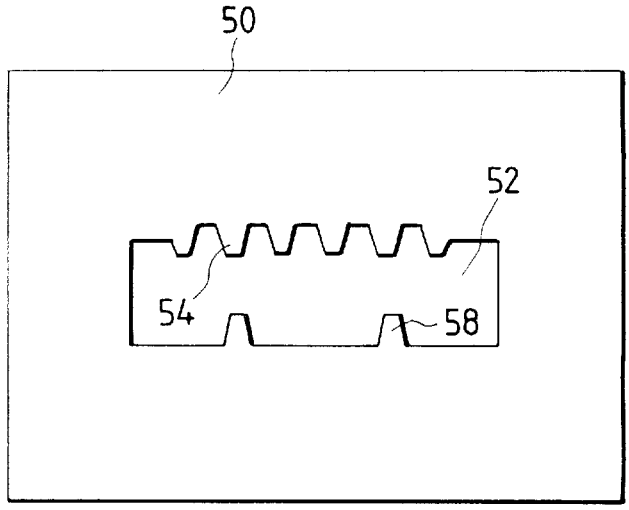
FIG. 21 is a front view showing another alteration of a grooved member constituting the liquid discharging head of the present invention.
Figure 22:
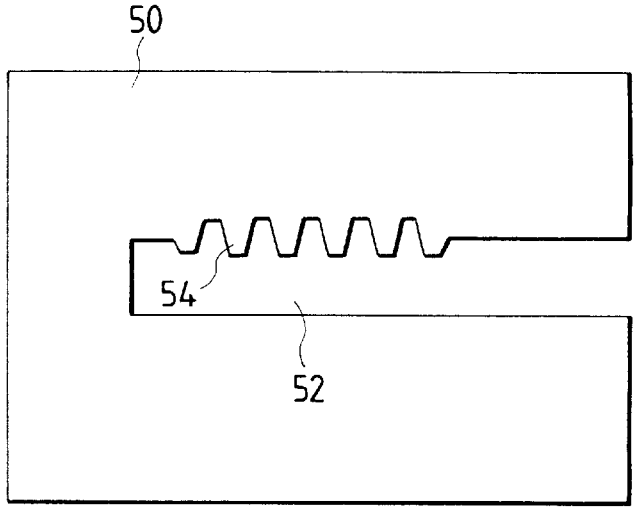
FIG. 22 is a front view showing a further alteration of a grooved member constituting the liquid discharging head of the present invention.
Figure 23:
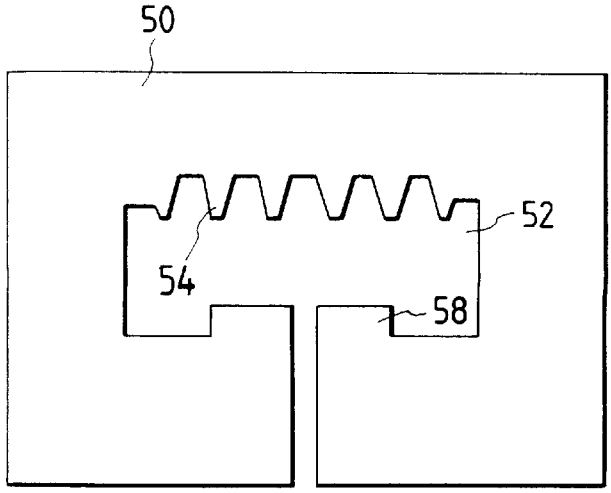
FIG. 23 is a front view showing a still further alteration of a grooved member constituting the liquid discharging head of the present invention.

FIGS. 21 to 23 show further alterations of the grooved member. As shown in FIG. 21, by providing ribs 58 on the inner surface of the opening portion 52 which is opposed to the groove walls 54, since the element substrate can be press-fitted into the grooved member while slightly deforming the ribs, the close contact between the element substrate 1 and the grooved member 50 can be improved, and, since the close contact force is determined by the distance between the tip ends of the ribs 58 and the tip ends of the groove walls 54, the desired close contact force can be easily obtained. Incidentally, in FIG. 21, while an example that two ribs 58 are provided was explained, more than one ribs may be provided, if necessary. Further, the ribs 58 may be used in combination of the tapered portion shown in FIGS. 16A, 16B, 17A and 17B.

So long as the element substrate is closely contacted with the groove walls 54 and at least a part of the inner surface (of the opening portion) opposed to the groove walls 54, a portion of the opening portion 52 which is to be contacted with a side surface of the element substrate may be removed (open to the outside of the grooved member 50) as shown in FIG. 22, or a portion of the rib 58 formed in the inner surface (of the opening portion) opposed to the groove walls 54 may be removed (open to the lower surface of the grooved member as shown in FIG. 23).

Figure 32:
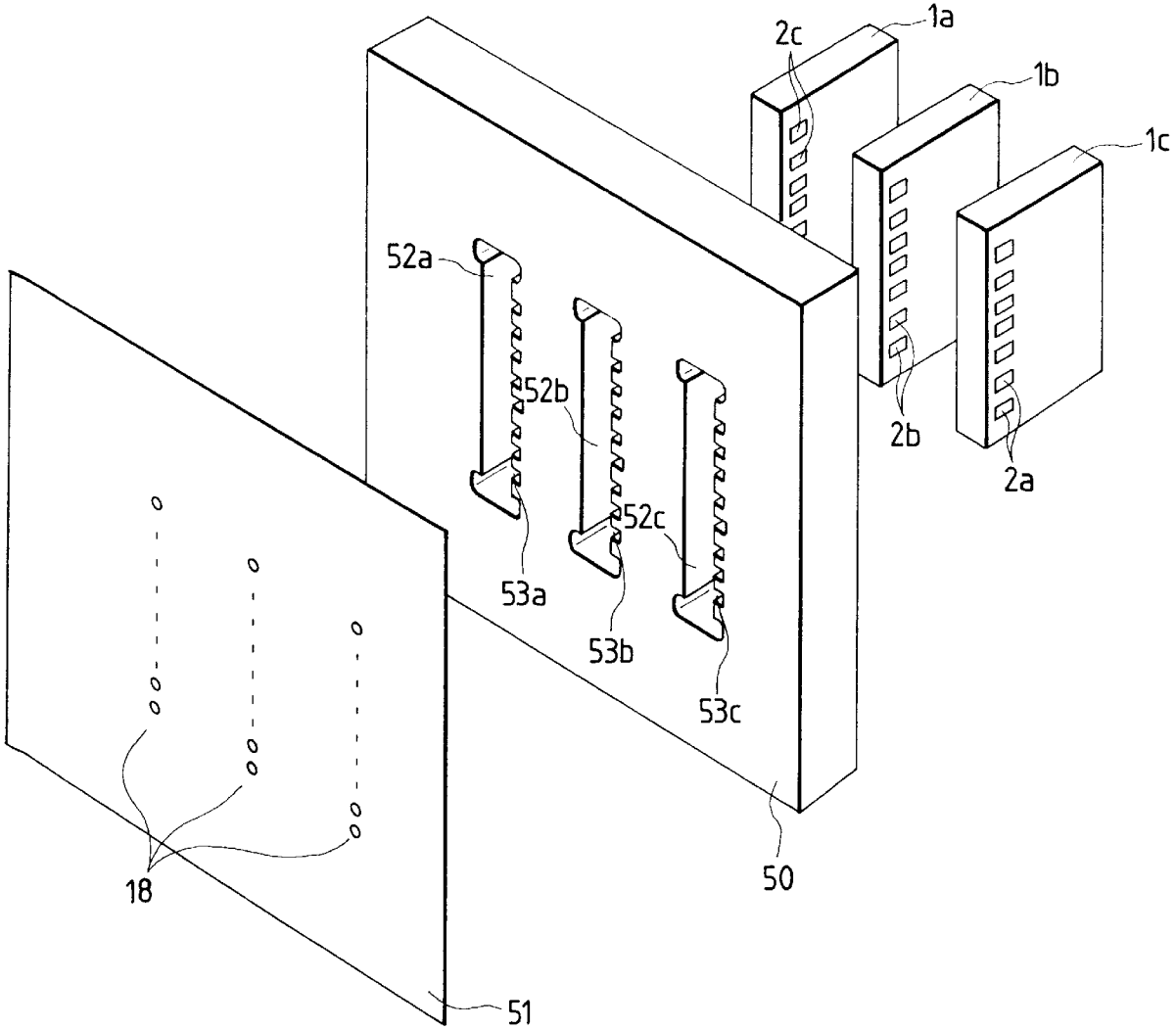
FIG. 32 is an exploded perspective view showing a liquid discharging head having a plurality of element substrates according to the present invention.
Figure 33:
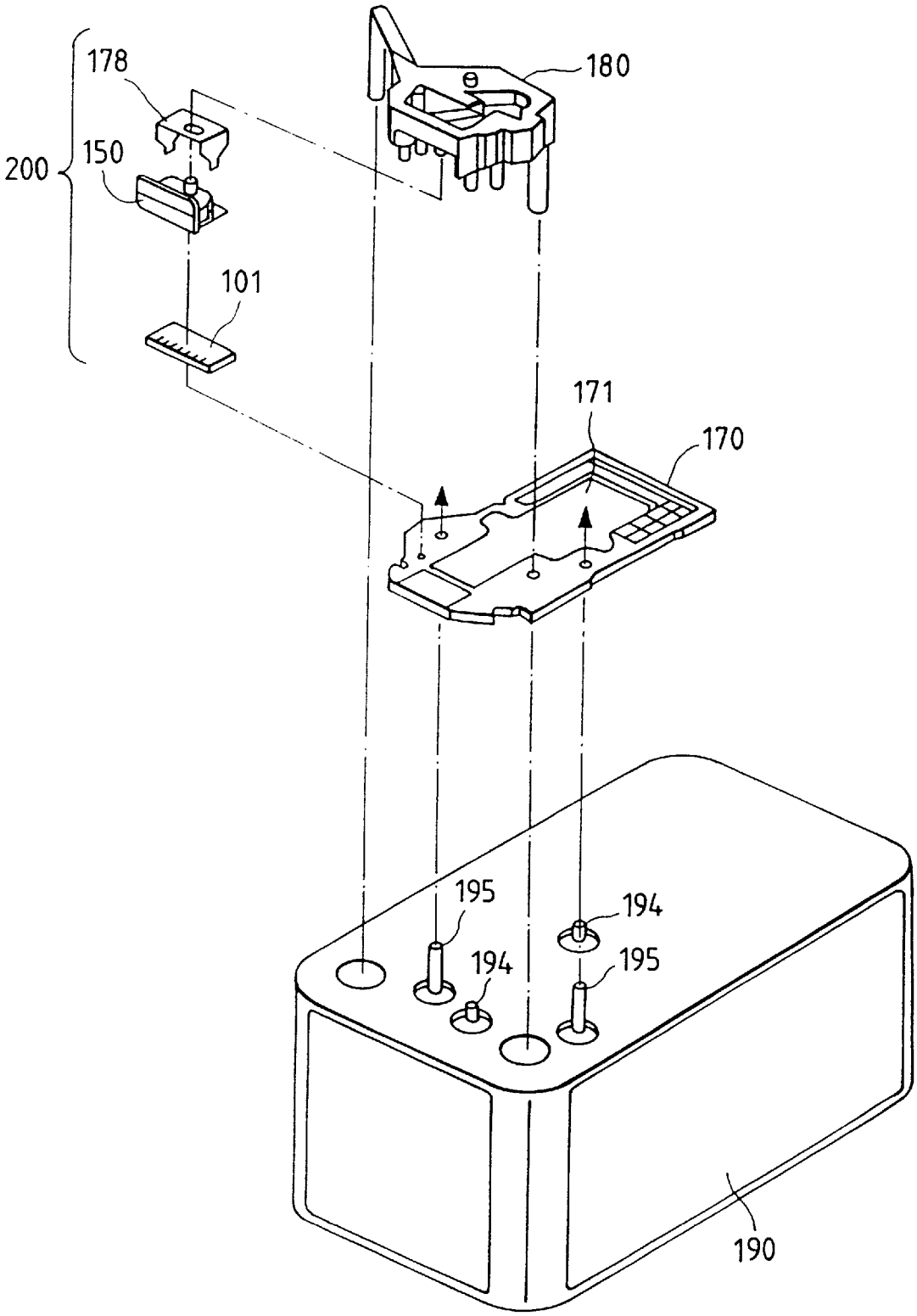
FIG. 33 PRIOR ART
FIG. 33 is an exploded perspective view of a conventional head cartridge comprised of a liquid discharging head and an ink tank.

FIG. 32 is an exploded perspective view of a liquid discharging head of color type according to the present invention. In this head, three element substrates 1*a,* 1*b,* 1*c* for discharging Y (yellow) color liquid, M (magenta) color liquid and C (cyan) color liquid are inserted into a single grooved member.

In FIG. 32, the grooved member 50 is provided with opening portions 52*a,* 52*b,* 52*c* into which the element substrates 1*a,* 1*b,* 1*c* are to be inserted. Also in this arrangement, heat generating elements 2*a,* 2*b,* 2*c* provided on the element substrates 1*a,* 1*b,* 1*c* can easily be aligned with grooves 53*a,* 53*b,* 53*c* formed in the grooved member 50. Further, since the grooves 53*a,* 53*b,* 53*c* and discharge openings 18 which correspond to the element substrates 1*a,* 1*b,* 1*c* are formed in the single grooved member 50 and a single orifice film 51, (in the conventional techniques, when a plurality of element substrates were combined to be used as a single liquid discharging head, it was difficult to achieve high accurate positioning of the element substrates) high accurate positioning can be achieved by merely inserting the element substrates into the grooved member.

Further, although it is preferable that the grooved member is formed from resin material to permit elastic deformation and to provide easy workability, the grooved member may be formed from an SUS substrate or a Si substrate. In this case, a difference between coefficients of thermal expansion of the element substrates and the grooved member can be reduced.

Next, a head cartridge including the liquid discharging head having the above-mentioned assembled structure will be explained. Here, a head cartridge including the fundamental head structure shown in FIG. 9 will be mainly described.

Figure 24:
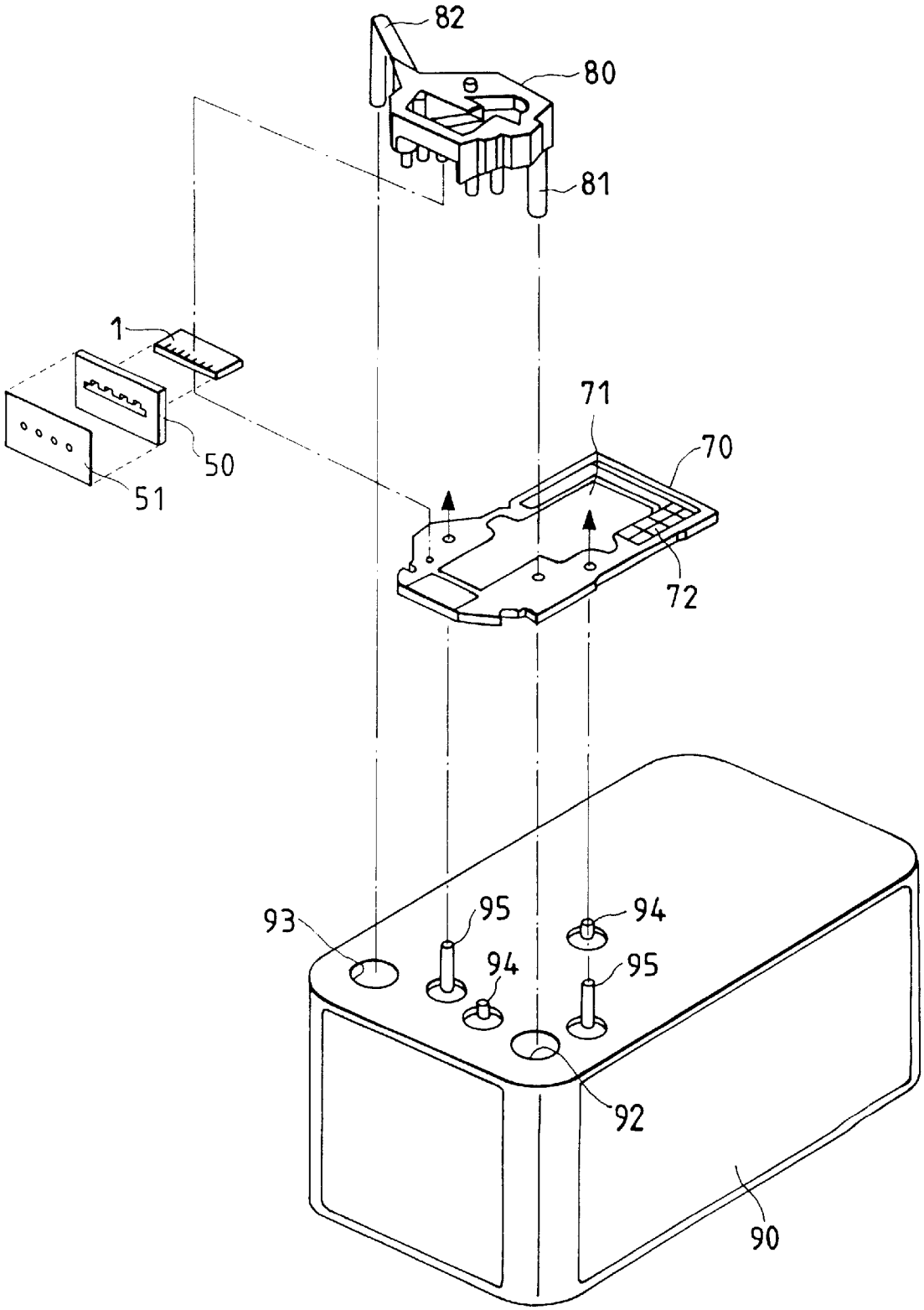
FIG. 24 is an exploded perspective view of a head cartridge comprised of a liquid discharging head and an ink tank according to a first embodiment of the present invention.

FIG. 24 is an exploded perspective view of a head cartridge according to a first embodiment of the present invention including a liquid discharging head and an ink tank.

In this embodiment, as shown in FIG. 24, the head cartridge comprises the liquid discharging head having the above-mentioned assembled structure, a base plate 70 as a substrate, a chip tank 80 as the liquid supply member and an ink tank 90 as a liquid container. The chip tank 80 is engaged by the element substrate 1 to form the common liquid chamber and is connected to the ink tank 90 to form the liquid supply passage communicated with the common liquid chamber. The base plate 70 serves to support the chip tank 80 engaged by the element substrate 1, and, on the base plate 70, there are disposed a printed wiring board 71 connected to the element substrate 1 and adapted to supply an electrical signal, and contact pads 72 for connection to the liquid discharging apparatus to perform communication between the cartridge and the apparatus.

The ink tank 90 contains the liquid to be supplied to the liquid discharging head (or two kinds of liquids when the discharge liquid differs from the bubble liquid). Connecting members 94, 95 for connecting the liquid discharging head to the ink tank 90 are disposed on an outer surface of the ink tank 90. The liquid is supplied from liquid supply passages 92, 93 of the ink tank 90 to liquid supply passages 81, 82 of the chip tank 80. Incidentally, after the liquid from the ink tank 90 is used up or consumed, new liquid may be replenished. To this end, a liquid pouring port may be provided in the ink tank 90. Further, the ink tank 90 may be integrally formed with the liquid discharging head or may removably be mounted on the liquid discharging head.

Next, other embodiments of a head cartridge will be explained.

Figure 25:
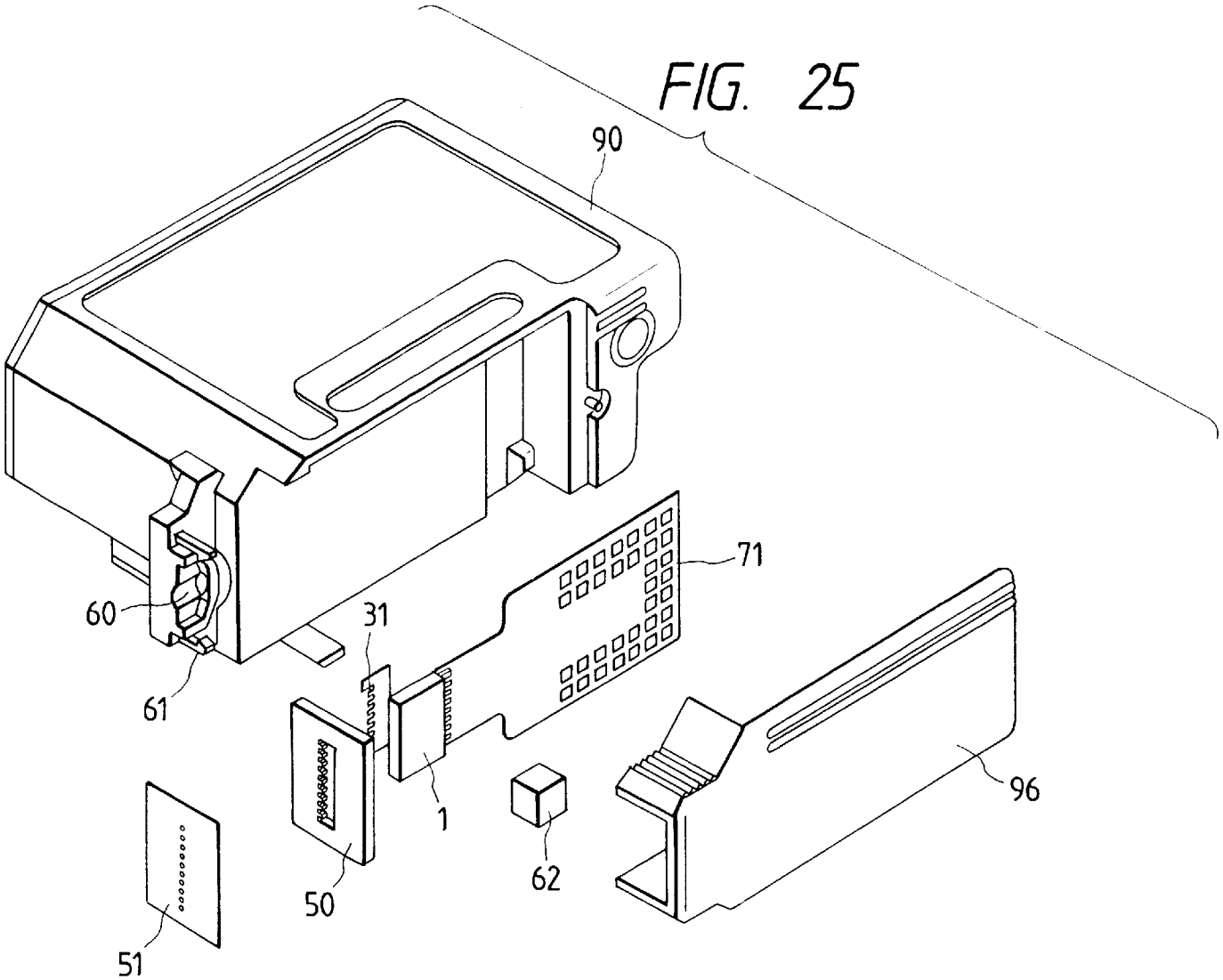
FIG. 25 is an exploded perspective view of a head cartridge having a liquid discharging head according to a second embodiment of the present invention.

FIG. 25 is an exploded perspective view showing a head cartridge according to a second embodiment of the present invention including the liquid discharging head of the present invention. In this embodiment shown in FIG. 25, a head cartridge includes an ink tank 90 having engaging portions 61 for engaging with the element substrate 1 press-fitted into the grooved member 50 and a liquid supply portion 60 for forming the common liquid chamber when connected to the element substrate 1. The separation wall having the movable members 31 is supported on the element substrate 1. When the cartridge is assembled, jointed areas between the grooved member 50 and the element substrate 1 (constituting the liquid discharging head) and the liquid supply portion 60 are sealed by sealing agent to prevent leakage of liquid. Further, after the assembling, the element substrate 1 and the printed wiring board 71 connected to the element substrate 1 are covered by a cover 96. The cover 96 may be omitted.

With this arrangement, since the chip tank as shown in FIG. 24 can be omitted, the number of parts can be reduced. Further, an aluminium block 62 may be attached to the element substrate 1 to suppress increase in temperature of the element substrate 1 by heat from the heat generating elements during the liquid discharging operation.

Figure 26:
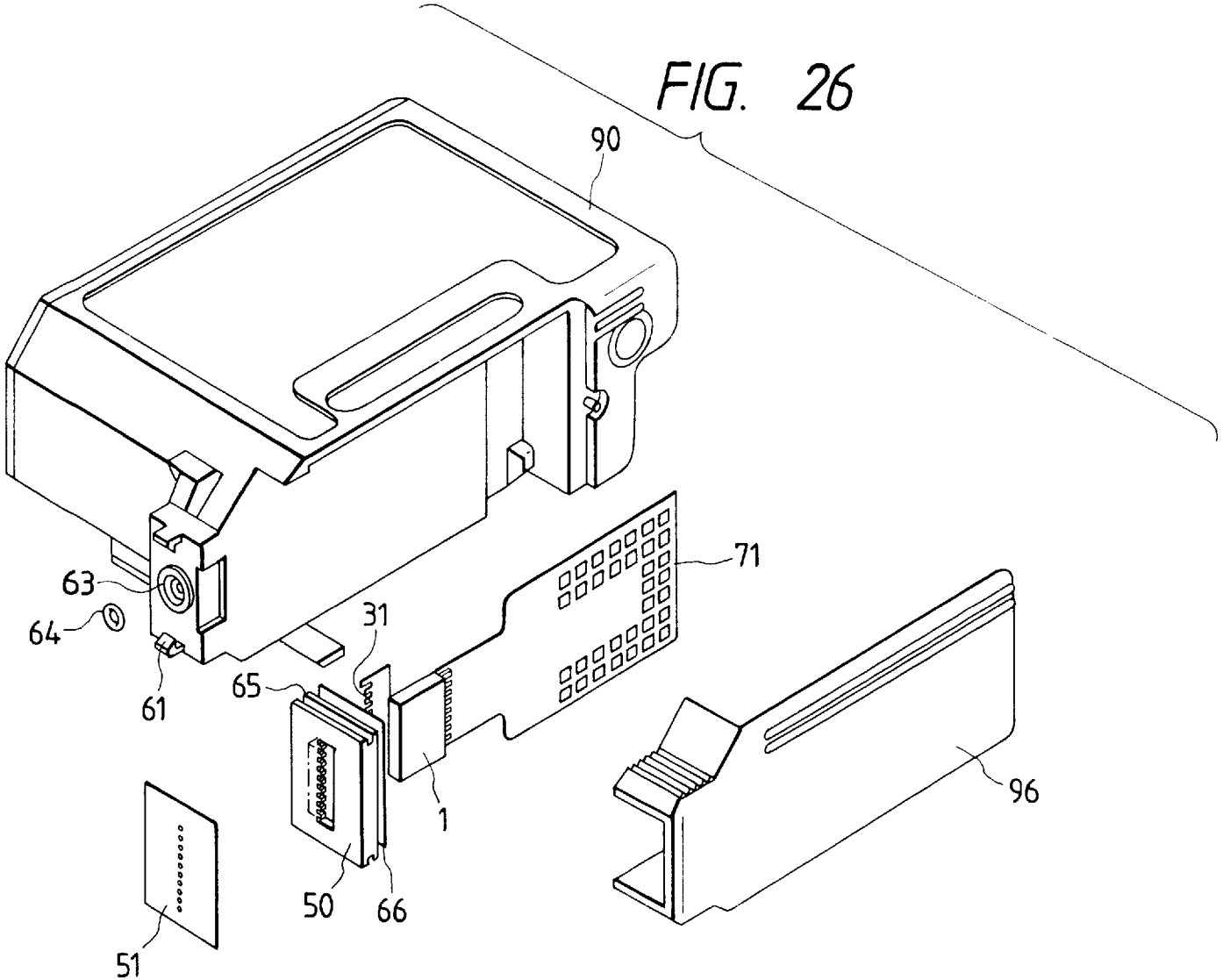
FIG. 26 is an exploded perspective view of a head cartridge having a liquid discharging head according to a third embodiment of the present invention.

FIG. 26 is an exploded perspective view showing a head cartridge according to a third embodiment of the present invention including the liquid discharging head of the present invention. In this embodiment shown in FIG. 26, a head cartridge includes an ink tank 90 having engaging portions 61 for engaging with the grooved member 50 into which the element substrate 1 is press-fitted and a liquid supply portion 63 for connecting to the grooved member 50 via a sealing tape 66 and an O-ring 64. Engaging grooves 65 associated with the engaging portions 61 of the ink tank 90 are formed in end faces of the grooved member 50. The grooved member 50 is provided with a recess (shown by dot and chain line in the grooved member in FIG. 26) for forming a common liquid chamber (to which the liquid is supplied from the liquid supply portion 63) when the grooved member is engaged by the ink tank 90. A separation wall having movable members 31 is supported on the element substrate 1. The ink tank 90 has a cover 96 for covering the element substrate 1 assembled to the liquid discharging head and the wiring substrate 71 connected to the element substrate 1.

Figure 27:
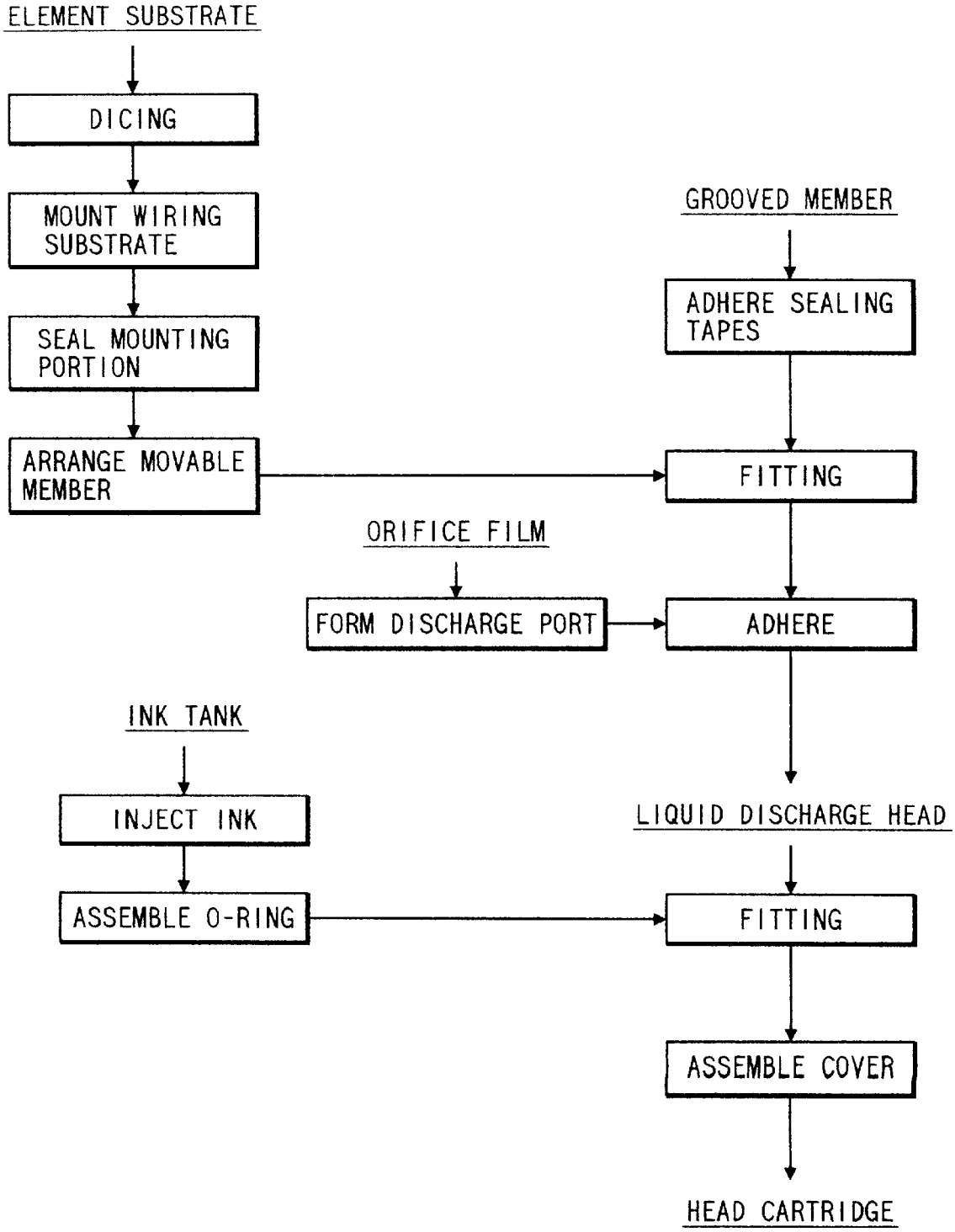
FIG. 27 is a flow chart showing assembling steps of the head cartridge according to the third embodiment of the present invention.

Now, a method for assembling the head cartridge according to the third embodiment will be explained with reference to FIG. 27. As shown in FIG. 27, the element substrate 1 on which the heat generating elements are disposed is subjected to dicing treatment to provide an element substrate having a desired dimension. The wiring substrate 71 for effecting communication of signal between the element substrate and an external equipment is electrically connected to the element substrate 1. A connection portion between the element substrate 1 and the wiring substrate 71 is sealed by sealing agent. The movable members 31 are disposed above the element substrate 1 in a confronting relation to the respective heat generating elements. Discharge openings are previously formed in the orifice film 51 at positions corresponding to the liquid passages. Ink is loaded in the ink tank 90 and the O-ring 64 is mounted on the liquid supply portion 63.

The sealing tape 66 is adhered to the grooved member 50, and then the element substrate 1 is press-fitted into the opening portion of the grooved member 50. Then, the orifice film 51 is adhered to the grooved member 50. The assembled liquid discharging head is attached to the ink tank 90. In this case, the engaging grooves 65 of the grooved member 50 are engaged by the engaging portions 61 of the ink tank 90. Thereafter, the cover 96 is attached to the ink tank 90 to cover the liquid discharging head and the wiring substrate 71. In this way, the head cartridge is completed.

According to such a head cartridge, in the assembling method thereof, since a step for applying the sealing agent to the engaged areas between the grooved member 50 and the element substrate 1 (constituting the liquid discharging head) and the liquid supply portion 60 of the ink tank 90 can be omitted, the assembling method can be simplified.

Figure 28:
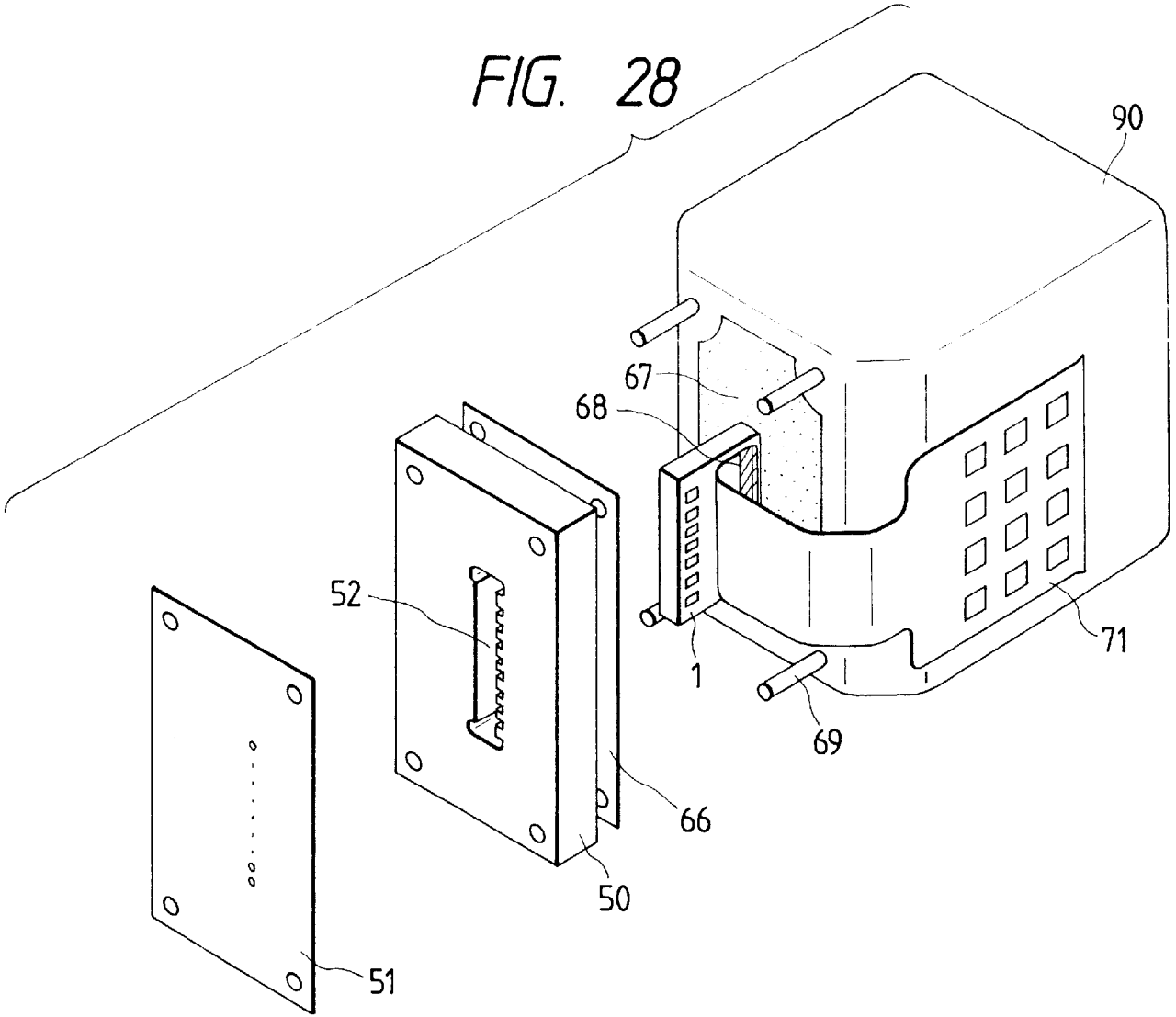
FIG. 28 is an exploded perspective view of a head cartridge having a liquid discharging head according to a fourth embodiment of the present invention.

FIG. 28 is an exploded perspective view of a head cartridge according to a fourth embodiment of the present invention including the liquid discharging head of the present invention. In this embodiment shown in FIG. 28, a head cartridge includes an ink tank 90 having an opening formed in a tank wall, an ink absorbing material 67 housed in the opening, and a plurality of caulking pins 69 disposed around the opening. In the assembling of the cartridge, the element substrate 1 is press-fitted into the opening portion 52 of the grooved member 50. The sealing tape 66, the grooved member 50 having the element substrate 1 attached thereto and the orifice film 51 are fitted onto the caulking pins 69 of the ink tank 90 in order. Then, tip end portions of the caulking pins 69 are thermally fused to closely contact the elements with each other. In this case, although a major part of the element substrate 1 is pushed into the ink absorbing material 67 of the ink tank 90, the wiring substrate 71 having a connection portion connected to the element substrate 1 and sealed by sealing agent 68 is exposed out of the assembly. Incidentally, in order to permit mounting and detaching between the ink tank and the liquid discharging head, as is in the above-mentioned embodiment, engaging portions may be provided on the ink tank and engaging grooves may be provided in the grooved member. The separation wall having the movable members 31 is supported on the element substrate 1.

The above-mentioned technical concept for providing the opening portion in the grooved member constituting the nozzles and for assembling the head by press-fitting the element substrate into the opening portion can be applied to a head of so-called side chute type in which discharge opening are disposed in a confronting relation to corresponding heat generating elements. Thus, a liquid discharging head of side chute type and a head cartridge having such a head will be briefly described.

Figure 29:
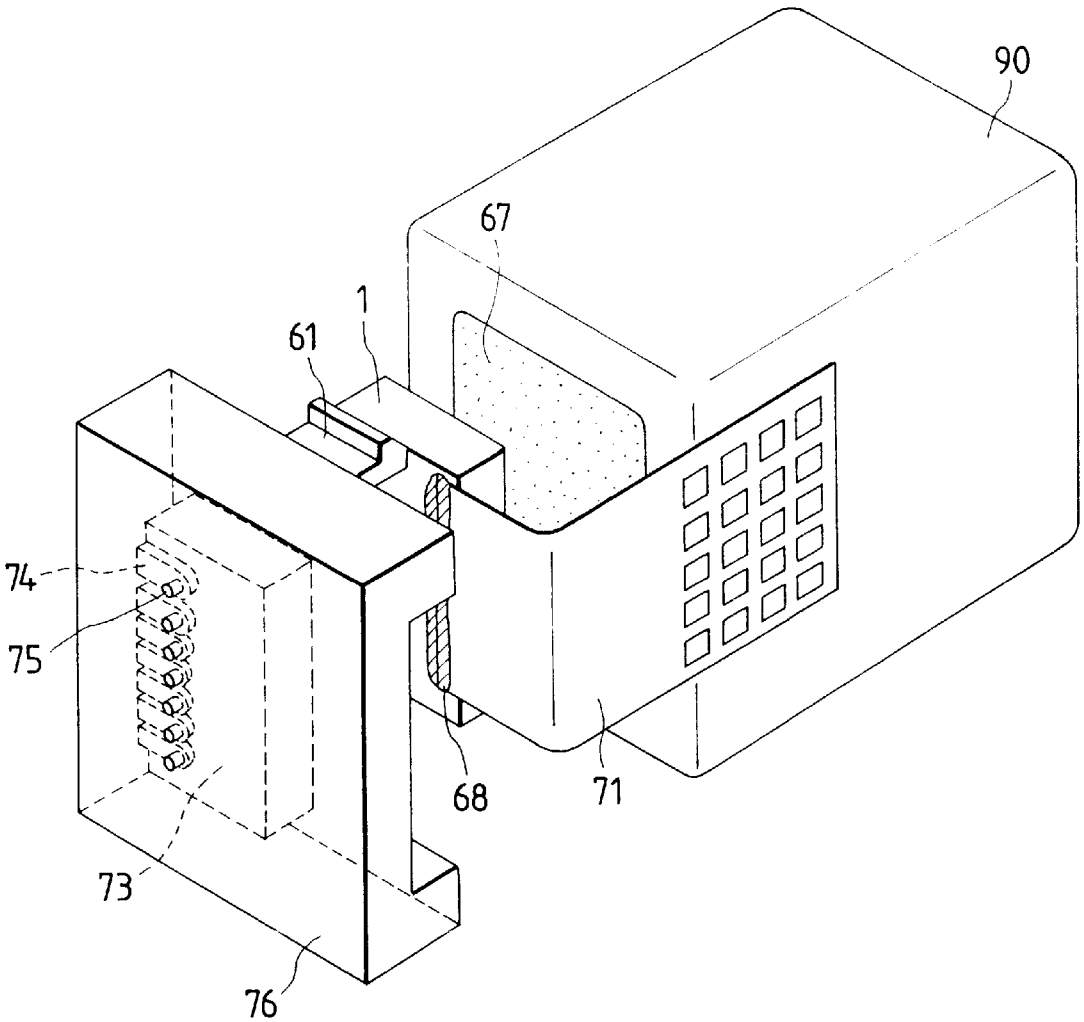
FIG. 29 is an exploded perspective view showing a liquid discharging head of side chute type and a head cartridge according to an embodiment of the present invention.

FIG. 29 is an exploded perspective view showing an embodiment of a liquid discharging head of side chute type and a head cartridge having such a head. The liquid discharging head shown in FIG. 29 comprises an element substrate 1 to which a connection portion (sealed by sealing agent 68) of a wiring substrate 71 is connected, and a grooved member 76 into which the element substrate 1 is press-fitted. The grooved member 76 includes a recess 73 into which a major part of the element substrate 1 can be press-fitted, a plurality of liquid passage grooves 74 to be aligned with corresponding heat generating elements on the element substrate 1 when the element substrate is press-fitted into the recess 73, and discharge openings 75 communicated with the respective liquid passage grooves 74. The recess 73 and the liquid passage grooves 74 may be simultaneously molded. Alternatively, the recess 73 may be molded and the liquid passage grooves 74 may be formed by excimer laser process. The discharge opening 75 are formed by excimer laser process. An ink tank 90 cooperating with the liquid discharging head to form a head cartridge has an opening formed in a tank wall, and ink absorbing material 67 is housed in the opening.

In assembling the cartridge, a major part of the element substrate 1 is press-fitted into the recess 73 of the grooved member 76, and then, the grooved member 76 is closely joined to the ink tank 90 by using engaging portions 61. In this case, although the element substrate 1 is pushed into the ink absorbing material 67 of the ink tank 90, the wiring substrate 71 is exposed out of the assembly. When the assembling is completed, the ink absorbing material 67 is communicated with the recess 73 of the grooved member 76.

Figure 30:
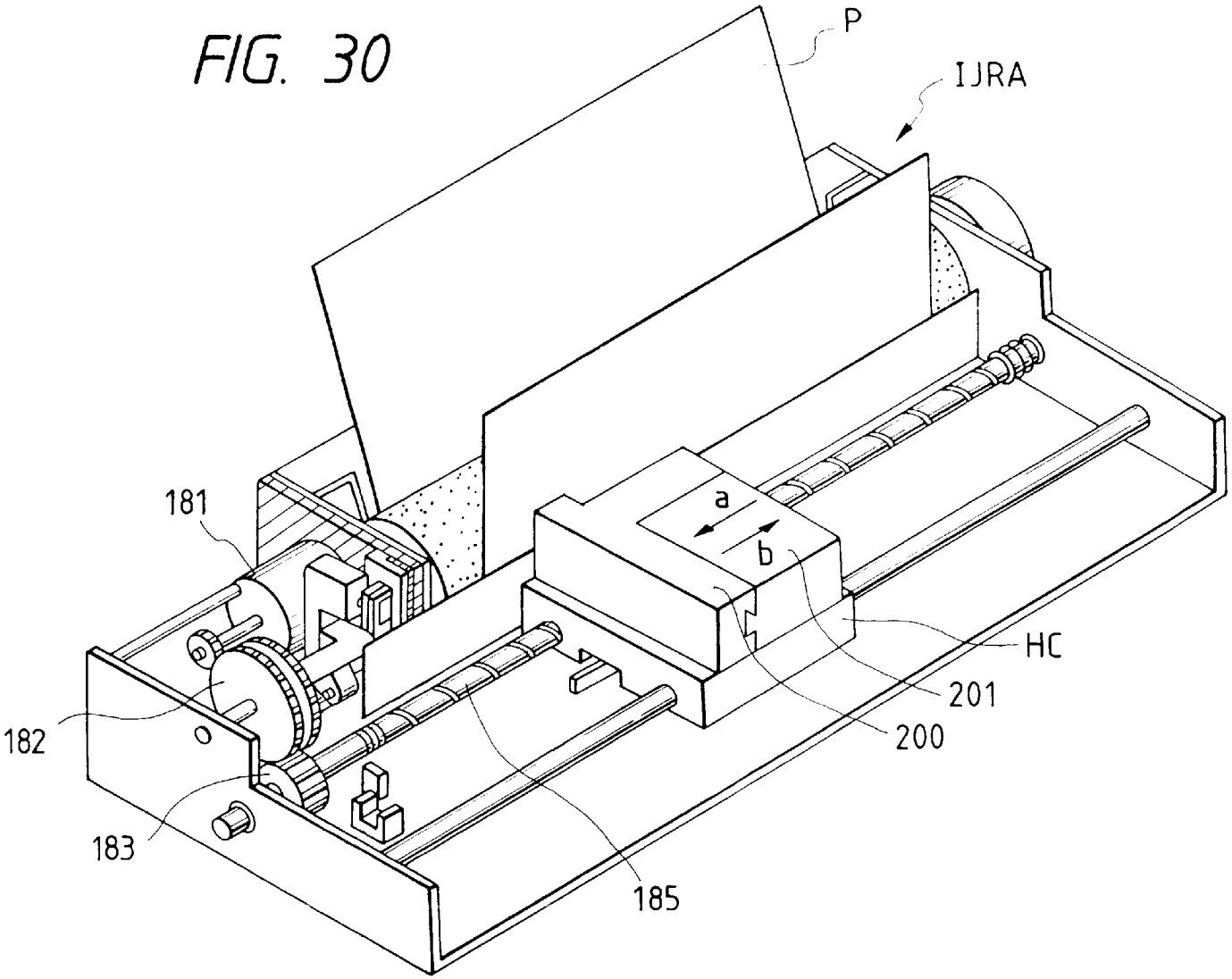
FIG. 30 is a schematic perspective view of a liquid discharging apparatus on which the head cartridge of the present invention is mounted.

FIG. 30 schematically shows a liquid discharging apparatus on which the above-mentioned liquid discharging head is mounted. In this example, particularly, an ink discharge recording apparatus IJRA using ink as the discharge liquid will be explained as the liquid discharging apparatus. The cartridge to which a liquid tank portion 201 for containing the ink and a liquid discharging head portion 200 are removably attached is mounted on a carriage HC of the apparatus. The carriage can be reciprocally shifted in a width-wise direction (directions a, b) of a recording medium P conveyed by a recording medium convey means.

When a drive signal is supplied from a drive signal supplying means (not shown) to the liquid discharging means on the carriage, the recording liquid is discharged from the liquid discharging head portion toward the recording medium in response to the drive signal.

Further, in the liquid discharging apparatus according to the illustrated embodiment, there are provided a motor (drive source) 181 for driving the recording medium convey means and the carriage, gears 182, 183 for transmitting a driving force from the drive source to the carriage, and a carriage shaft 185. By discharging the liquid onto various kinds of recording medium by using the recording apparatus and the liquid discharging method (effected in the recording apparatus), a good image can be recorded on the recording medium.

Figure 31:
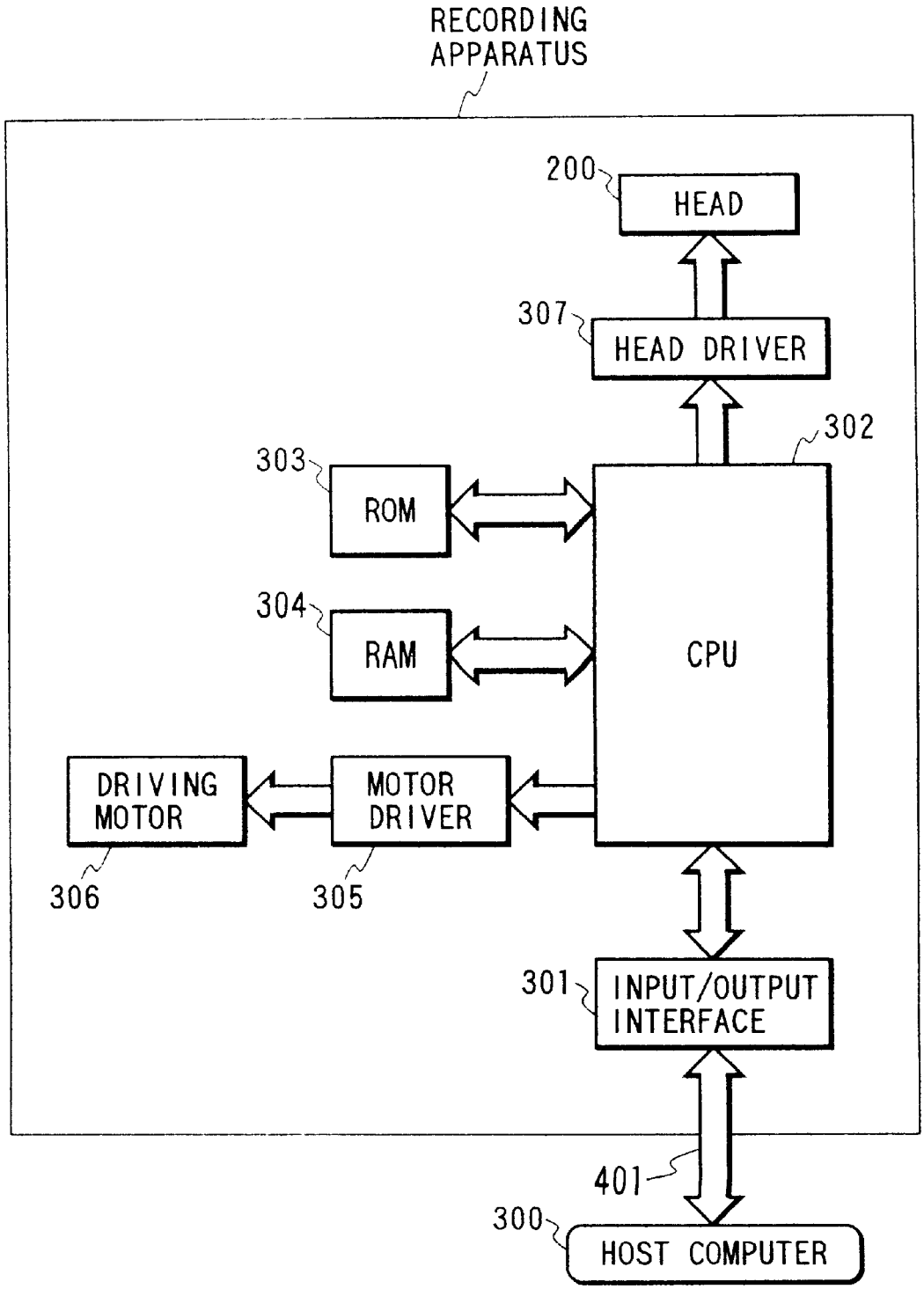
FIG. 31 is a block diagram of an apparatus for effecting ink discharge recording to which the liquid discharging head of the present invention is applied.

FIG. 31 is a block diagram of the entire of the apparatus for performing the ink discharge recording by using the liquid discharging head of the present invention.

In the recording apparatus, a host computer 300 receives recording information as a control signal. The recording information is temporarily stored in an input/output interface 301 of the apparatus and, at the same time, is converted into a treatable data in the apparatus. The data is inputted to a CPU 302 also acting as the head drive signal supplying means. The CPU 302 treats the input data on the basis of control program stored in a ROM 303, by utilizing peripheral units such as a RAM 304, to convert the input data into print data (image data).

Further, the CPU 302 produces drive data for driving a drive motor 306 for shifting the recording medium and the head 200 in synchronous with the image data in order to record the image data on a proper position on the recording medium. The image data and the motor drive data are transmitted to the head 200 and the drive motor 306 through a head driver 307 and a motor driver 305, respectively, thereby driving the head and motor at a controlled timing to form an image.

The recording medium applicable to the above-mentioned recording apparatus and capable of receiving the liquid such as ink may be various kinds of paper sheets, an OHP sheet, a plastic plate used in a compact disc or an ornament plate, cloth, a metal sheet made of aluminium, copper or the like, leather, pigskin, synthetic leather, wood, a wood board, a bamboo sheet, a ceramic sheet such as a tile, or three-dimensional articles such as sponge.

Further, the recording apparatus may include a printer for effecting the recording on various kinds of paper sheets or an OHP sheet, a plastic recording apparatus for effecting the recording on plastic material such as a compact disc, a metal recording apparatus for effecting the recording on metal, a leather recording apparatus for effecting the recording on leather, a wood recording apparatus for effecting the recording on wood, a ceramic recording apparatus for effecting the recording on ceramic material, a recording apparatus for effecting the recording on a three-dimensional net article such as sponge, and a print apparatus for effecting the recording on cloth.

Further, the discharge liquid used in these liquid discharging apparatuses may be selected in accordance with the kind of a recording medium and a recording condition.

In the ink jet recording system for effecting the recording on the recording medium by using the liquid discharging head according to the present invention as a recording head, there may be provided a pre-treatment device adapted to perform pre-treatment regarding the recording medium before the recording is started and disposed at an upstream side in a recording medium conveying path, and a post-treatment device adapted to perform post-treatment regarding the recording medium after the recording is finished and disposed at a downstream side in the recording medium conveying path.

The pre-treatment and post-treatment are varied in accordance with the kind of the recording medium to be recorded and/or the kind of ink. For example, regarding the recording medium made of metal, plastic or ceramic, as the pre-treatment, ultraviolet ray and ozone are illuminated onto the recording medium to make a surface of the recording medium active, thereby improving the adhering ability of ink to the recording medium. Further, in case of the recording medium (for example, plastic) which easily generates static electricity, dirt is apt to be adhered to the surface of the recording medium due to the static electricity, resulting in prevention of good recording. Thus, regarding such a recording medium, as the pre-treatment, the static electricity is removed from the recording medium by using an ionizer device to remove dirt on the recording medium. Further, when the cloth is used as the recording medium, in a view point of prevention of blot and improvement in coloring ability, as the pre-treatment, material selected among alkaline substance, water-soluble substance, synthetic polymer, water-soluble metal chloride, urea and chiourea may be added to the cloth. The pre-treatment is not limited above-mentioned examples, but, may include treatment for adjusting a temperature of the recording medium to a temperature suitable for the recording.

On the other hand, the post-treatment may include heat treatment of the recorded recording medium, fixing treatment for promoting the fixing of ink by illumination of ultraviolet ray and cleaning treatment for cleaning the residual treatment agent.

As mentioned above, according to the present invention, since there is provided a liquid discharging head in which a (grooved) member is provided with an opening portion having a plurality of grooves and liquid passages are defined between an element substrate and the grooves of the opening portion by press-fitting the element substrate into the opening portion of the member, the number of parts can be reduced and the head can be assembled easily and cheaply, in comparison with the conventional heads. Particularly, since the grooved member has a simple structure only including the plurality of grooves, the grooved member can easily be manufactured and is effective to high density nozzle arrangement. Further, since chamber in the grooved member generated during the manufacture thereof can be corrected by press-fitting the element substrate into the opening portion of the grooved member, an elongated substrate can be used. Since the element substrate is inserted into the opening portion in a direction perpendicular to the array of grooves, walls defining the grooves are not damaged. Since the element substrate and the grooved member are closely contacted with each other after the press-fit of the element substrate, any holding spring is not required.

By using the new liquid discharging principle utilizing movable members in a liquid discharging head, advantages generated by both the bubble generated and the movable member displaced by the bubble pressure can be achieved. Thus, since the liquid near the discharge opening can be discharged efficiently, the liquid discharging efficiency can be improved greatly in comparison with the conventional bubble jet heads.

Further, according to the characteristic arrangement of the present invention, even when the head is placed under a low temperature and/or low humidity condition for a long time, the poor discharging can be suppressed or prevented; and, if the poor discharging occurs, the normal condition can easily be restored by effecting simple preliminary discharge and/or suction recovery. Therefore, the recovery time and loss of liquid due to recovery can be reduced, thereby reducing the running cost greatly.

Further, according to the arrangement of the present invention for improving the re-fill feature, the response in the continuous discharging, stable growth of the bubble and the stabilizing of liquid droplet can be achieved, thereby permitting the high speed recording due to high speed liquid discharge and the high quality image recording.

In addition, regarding the head of two-passage type, when the liquid in which the bubble can easily be generated or the liquid in which deposit is hard to be accumulated on the heat generating element is used as the bubble liquid, degree of freedom of selection of the discharge liquid is increased, with the result that high viscous liquid in which the bubble is hard to be generated and the liquid in which deposit is apt to be accumulated on the heat generating element (which liquids is hard to be discharged in the conventional bubble jet discharging methods) can be discharged effectively.

Further, the liquid having poor resistance to heat can be discharged without deterioration of the liquid due to the heat.

Further, by using the liquid discharging head of the present invention as a recording liquid discharging head, a high quality image can be obtained.

What is claimed is:

1. A liquid discharging head comprising a substrate having a plurality of heat generating elements for generating a bubble in liquid and a grooved member having a plurality of grooves constituting a plurality of liquid passages and in which said liquid passages for said respective heat generating elements are formed by joining said grooved member to said substrate, wherein said grooved member has an opening portion into which said substrate is inserted under pressure and said opening portion has on an inner surface thereof a plurality of said grooves which are joined to said substrate for each said heat generating member to define said liquid passages when said substrate is inserted under pressure.

2. A liquid discharging head according to claim 1, wherein at least portions of a surface of said opening portion in which said plurality of grooves are formed and of an opposed surface of said opening portion opposed to said surface are closely contacted with said substrate when said substrate is inserted into said opening portion of said grooved member.

3. A liquid discharging head according to claim 1, wherein said opening portion is opened so that said substrate can be inserted into said opening portion from a direction perpendicular to an array of said plurality of grooves.

4. A liquid discharging head according to claim 1, wherein said opening portion is provided with at least one tapered portion.

5. A liquid discharging head according to claim 1, wherein at least one rib is provided on said opposed surface of said opening portion opposed to said surface in which said plurality of grooves are formed.

6. A liquid discharging head according to claim 1, wherein a plurality of recessed grooves for engaging by a plurality of groove walls defining said plurality of grooves in said opening portion are formed in a surface of said substrate which is contacted with said groove walls.

7. A liquid discharging head according to claim 1, wherein said grooved member has discharge openings communicated with said plurality of grooves of said opening portion.

8. A method for manufacturing a liquid discharging head according to claim 1, comprising the steps of:

inserting the substrate into the opening portion while widening said opening portion when said substrate is inserted into said opening portion of the grooved member; and securely holding said substrate within said opening portion by a restoring force of the grooved member.

9. A method according to claim 8, wherein, in order to widen said opening portion of said grooved member, heat is applied to said grooved member and tension is applied to said grooved member in directions that said opening portion is widened.

10. A liquid discharging head according claim 1, further comprising movable members each of which is disposed in a confronting relation to the corresponding heat generating element and has a free end near a corresponding discharge opening and serves to direct pressure of a bubble generated by said corresponding heat generating element toward said corresponding discharge opening by displacing said free end by the bubble pressure.

11. A liquid discharging head according claim 1, further comprising:

movable members each of which is disposed in a confronting relation to the corresponding heat generating element and has a free end near a corresponding discharge opening and serves to direct pressure of a bubble generated by said corresponding heat generating element toward said corresponding discharge opening by displacing said free end by the bubble pressure; and liquid supply passages for supplying the liquid onto said heat generating elements from an upstream side along surfaces of said movable members near said heat generating elements.

12. A liquid discharging head according claim 1, wherein said liquid passages are divided into first liquid passages communicated with discharge openings and second liquid passages each including a bubble generating area in which a bubble is generated in the liquid by applying heat to the liquid, and further comprising movable members each having a free end near the corresponding discharge opening and each serving to direct pressure of a bubble generated in said corresponding bubble generating area toward the corresponding discharge opening of said first liquid passage by displacing said free end toward said first liquid passage by the bubble pressure.

13. A liquid discharging head according to claim 10, 11 or 12, wherein said free end of each movable member is positioned at a downstream side of a center of an area of the corresponding heat generating element.

14. A liquid discharging head according to claim 12, wherein said movable members are formed as a part of a separation wall disposed between said first liquid passages and said second liquid passages.

15. A liquid discharging head according to claim 14, wherein said separation wall is made of metallic material.

16. A liquid discharging head according to claim 15, wherein the metallic material is nickel or gold.

17. A liquid discharging head according to claim 14, wherein said separation wall is made of resin.

18. A liquid discharging head according to claim 12, wherein said movable members are disposed in a confronting relation to said heat generating elements, and said bubble generating areas are defined between said movable members and said heat generating elements.

19. A liquid discharging head according to claim 18, further comprising a supply passage for supplying the liquid onto said heat generating elements from an upstream side of said heat generating elements along said heat generating elements.

20. A liquid discharging head according to claim 10, 11 or 19, wherein the bubble is generated by causing film-boiling in the liquid by heat generated by said heat generating element.

21. A liquid discharging head according to claim 10, 11 or 18, wherein said movable members each has a plate-shape.

22. A liquid discharging head comprising:

an element substrate having a plurality of heat generating elements for generating a bubble in liquid;

a grooved member having an opening portion into which said element substrate is inserted and a plurality of grooves for constituting a plurality of liquid passages when said element substrate is inserted in said opening portion; and a separation wall for dividing said liquid passages into first liquid passages communicated with discharge openings and second liquid passages within which the respective heat generating elements are disposed, said separation wall having movable members each capable of being displaced toward said first liquid passage by pressure of a generated bubble; and wherein the pressure is directed toward the corresponding discharge opening by said movable member thereby to discharge the liquid.

23. A liquid discharging head according to claim 22, further comprising an orifice film in which a plurality of said discharge openings are formed and which is adhered to said grooved member.

24. A liquid discharging head according to claim 12 or 22, wherein the liquid supplied to said first liquid passages is the same as the liquid supplied to said second liquid passages.

25. A liquid discharging head according to claim 12 or 22, wherein the liquid supplied to said first liquid passages differs from the liquid supplied to said second liquid passages.

26. A liquid discharging head according to claim 10, 11, 12 or 22, wherein each of said heat generating elements comprises an electro/thermal converter having a heat generating body for generating heat by receiving an electrical signal.

27. A liquid discharging head according to claim 12 or 22, wherein said second liquid passages within which said bubble generating areas or said heat generating elements are disposed each has a chamber-like shape.

28. A liquid discharging head according to claim 10, 11, 12 or 22, wherein the liquid discharged from said discharge openings is ink.

29. A head cartridge comprising:

a liquid discharging head according to claim 10, 11, 12 or 22;

a liquid container holding the liquid to be supplied to said liquid discharging head; and liquid conveying means for conveying the liquid to said liquid discharging head.

30. A head cartridge according to claim 29, wherein said liquid discharging head is detachably connected to said liquid container.

31. A head cartridge according to claim 29, wherein said liquid container is provided with a liquid pouring opening for replenishing the liquid.

32. A head cartridge comprising:

a liquid discharging head according to claim 12 or 22;

a liquid container holding first liquid to be supplied to the first liquid passages and second liquid to be supplied to the second liquid passages; and liquid conveying means for conveying the liquid to said liquid discharging head.

33. A liquid discharging head comprising:

a plurality of substrates each having a plurality of heat generating elements for generating a bubble in liquid; and a grooved member having a plurality of opening portions into which the respective substrates are inserted and a plurality of grooves constituting a plurality of liquid passages for each of said opening portions; and wherein by inserting said plurality of substrates into the respective opening portions, respectively, said substrates are joined to said grooved member and said liquid passages for said respective heat generating elements are formed.

34. A liquid discharging head according to claim 33, further comprising discharge openings communicated with said liquid passages.

35. A liquid discharging head according to claim 34, further comprising an orifice film in which a plurality of said discharge openings are formed and which is adhered to said grooved member.

36. A liquid discharging head according to claim 34, further comprising movable members each of which is disposed in a confronting relation to the corresponding heat generating element and has a free end near the corresponding discharge opening and serves to direct pressure of a bubble generated by said corresponding heat generating element toward said corresponding discharge opening by displacing said free end by the bubble pressure.

37. A liquid discharging head according to claim 33, wherein ink of different color is discharged for each of said plurality of substrates.

38. A liquid discharging apparatus comprising:

a liquid discharging head according to claim 10, 11, 12, 22 or 33;

a drive signal supplying means for supplying a drive signal to said liquid discharging head to cause a discharge of the liquid from said liquid discharging head.

39. A liquid discharging apparatus according to claim 38, wherein ink is discharged from said liquid discharging head, and the discharged ink is adhered to a recording sheet.

40. A liquid discharging apparatus according to claim 38, wherein recording liquid is discharged from said liquid discharging head, and the discharged recording liquid is adhered to cloth, plastic, metal, leather or wood.

41. A liquid discharging apparatus according to claim 38, wherein plural color of recording liquids are discharged from said liquid discharging head, and the discharged plural color of recording liquids are adhered to a recording medium.

42. A liquid discharging apparatus comprising:

a liquid discharging head according to claim 10, 11, 12, 22 or 33; and a recording medium conveying means for conveying a recording medium past the liquid discharging head to receive the liquid discharged from said liquid discharging head.

* * * * *

UNITED STATES PATENT AND TRADEMARK OFFICE

CERTIFICATE OF CORRECTION

PATENT NO. : 6,378,992 B2
DATED : April 30, 2002
INVENTOR(S) : Kiyomitsu Kudo et al.

It is certified that error appears in the above-identified patent and that said Letters Patent is hereby corrected as shown below:

Title page,
Item [56], U.S. PATENT DOCUMENTS, “Asai” should read -- Asai et al. --; and “Kubo” should read -- Kudo et al. --.
FOREIGN PATENT DOCUMENTS, “5/1909” should read -- 5/1996 --.

Column 4,
Line 4, “is” should read -- are --.

Column 5,
Line 13, “is” should read -- has --; and
Line 26, “is being disappeared,” should read -- is disappearing, --.

Column 6,
Line 37, “affecting” should read -- effecting --.

Column 9,
Line 65, “advantages same” should read -- same advantages --.

Column 10,
Line 18, “elongated” should read -- elongated, --.

Column 15,
Line 9, “heat” should read -- heat to --.

Column 21,
Line 63, “opening” should read -- openings --.

UNITED STATES PATENT AND TRADEMARK OFFICE

CERTIFICATE OF CORRECTION

PATENT NO. : 6,378,992 B2 
DATED : April 30, 2002
INVENTOR(S) : Kiyomitsu Kudo et al.

It is certified that error appears in the above-identified patent and that said Letters Patent is hereby corrected as shown below:

Column 23,
Line 63, "Particularly," should read -- ¶ Particularly, --.

Signed and Sealed this

Twenty-fourth Day of June, 2003

JAMES E. ROGAN
*Director of the United States Patent and Trademark Office*